US010836622B2

(12) United States Patent
Meinzinger

(10) Patent No.: US 10,836,622 B2
(45) Date of Patent: Nov. 17, 2020

(54) METHOD AND DEVICE FOR FILLING A CONTAINER

(71) Applicant: Krones AG, Neutraubling (DE)

(72) Inventor: Rupert Meinzinger, Kirchroth (DE)

(73) Assignee: KRONES AG, Neutraubling (DE)

( * ) Notice: Subject to any disclaimer, the term of this patent is extended or adjusted under 35 U.S.C. 154(b) by 101 days.

(21) Appl. No.: 14/678,861

(22) Filed: Apr. 3, 2015

(65) Prior Publication Data

US 2015/0284234 A1 Oct. 8, 2015

(30) Foreign Application Priority Data

Apr. 4, 2014 (DE) ..... 10 2014 104 873

(51) Int. Cl.

| | |
|---|---|
| ***B67C 3/16*** | (2006.01) |
| ***B67C 7/00*** | (2006.01) |
| ***B67C 3/10*** | (2006.01) |
| ***B67C 3/22*** | (2006.01) |
| ***B67C 3/26*** | (2006.01) |

(52) U.S. Cl.

CPC ..... *B67C 3/16* (2013.01); *B67C 3/10* (2013.01); *B67C 3/225* (2013.01); *B67C 3/2634* (2013.01); *B67C 7/00* (2013.01); *B67C 2003/2697* (2013.01); *B67C 2007/0066* (2013.01)

(58) Field of Classification Search

CPC .... B67C 3/10; B67C 3/16; B67C 3/26; B67C 3/225; B67C 3/2634; B67C 7/00; B67C 2003/2697; B67C 2007/0066

USPC ..... 141/6, 61, 65, 66, 7

See application file for complete search history.

(56) References Cited

U.S. PATENT DOCUMENTS

| | | | | |
|---|---|---|---|---|
| 270,434 | A * | 1/1883 | Hunt et al. | B67C 3/16 141/54 |
| 931,649 | A * | 8/1909 | Redington | B67C 7/0093 53/274 |
| 949,479 | A * | 2/1910 | Hicks | B63B 27/24 141/387 |
| 1,770,380 | A * | 7/1930 | Young | B67B 3/24 137/636.1 |
| 2,066,356 | A * | 1/1937 | McCrosson | A23L 3/0155 141/169 |
| 2,114,964 | A * | 4/1938 | MacKenzie | B67B 3/24 53/432 |

(Continued)

FOREIGN PATENT DOCUMENTS

| | | |
|---|---|---|
| DE | 83 08 618.8 U1 | 7/1983 |
| DE | 83 08 806.7 U1 | 8/1983 |

(Continued)

OTHER PUBLICATIONS

Partial Search Report, dated Sep. 3, 2015, 5 pages, European Patent Application 15162338.6.

(Continued)

*Primary Examiner* — Timothy L Maust
*Assistant Examiner* — James R Hakomaki
(74) *Attorney, Agent, or Firm* — Haynes and Boone, LLP

(57) ABSTRACT

A method for filling a container with a filling product in, for example, a beverage bottling plant is described. The method includes providing a filling product under a positive pressure, evacuating the container to be filled to achieve a negative pressure, and feeding the filling product into the container.

18 Claims, 15 Drawing Sheets

(56) References Cited

U.S. PATENT DOCUMENTS 2,124,581 A 7/1938 Luthi
2,138,355 A * 11/1938 Ryan ..... B67C 3/22 141/179
2,660,357 A 11/1953 Fechheimer
2,718,345 A * 9/1955 Howard ..... B65B 31/044 141/172
2,808,856 A * 10/1957 Tiano et al. ..... B67C 3/16 141/48
2,815,621 A * 12/1957 Carter ..... B65B 1/26 100/90
2,855,006 A * 10/1958 Geisler ..... B65B 31/08 141/7
3,321,887 A * 5/1967 Manas ..... B67C 3/26 53/467
3,350,839 A * 11/1967 Carter ..... B67C 7/0073 53/88
3,356,510 A * 12/1967 Barnby ..... B65B 55/02 426/399
3,477,192 A * 11/1969 Brown ..... B65B 31/025 206/205
3,699,740 A * 10/1972 Knabe ..... B67C 3/10 53/432
3,741,552 A * 6/1973 Skoli ..... B01F 3/04815 261/140.1
3,802,471 A * 4/1974 Wickenhauser ..... B67C 3/32 141/39
3,804,133 A * 4/1974 Copping ..... B67C 3/10 141/37
3,911,972 A * 10/1975 Hubers ..... H01M 2/361 141/7
4,060,956 A * 12/1977 Goble ..... B65B 31/025 141/5
4,103,721 A * 8/1978 Noguchi ..... B67C 3/10 141/302
4,637,438 A * 1/1987 Weiss ..... B67C 3/10 141/39
4,729,204 A * 3/1988 Weiss ..... B65B 31/00 53/88
4,989,650 A * 2/1991 Weiss ..... B67C 3/06 141/39
5,031,673 A * 7/1991 Clusserath ..... B65B 55/10 141/11
5,240,048 A * 8/1993 Diehl ..... B67C 3/12 141/39
5,558,135 A * 9/1996 Kronseder ..... B67C 3/10 141/39
5,642,761 A * 7/1997 Holbrook ..... B67C 3/06 141/104
5,682,929 A * 11/1997 Maginot ..... B65B 1/16 141/10
5,743,311 A * 4/1998 Crossdale ..... B67D 7/02 141/31
6,082,418 A * 7/2000 Naecker ..... B65B 31/022 141/145
6,220,310 B1 4/2001 Emmer
6,248,138 B1 * 6/2001 Lafave ..... H01M 2/06 29/623.1
6,267,153 B1 * 7/2001 Stocchi ..... B65B 55/10 141/48
6,457,495 B1 * 10/2002 Meheen ..... B67C 3/10 141/40
6,474,368 B2 * 11/2002 Clusserath ..... B67C 3/286 141/129
7,757,896 B2 * 7/2010 Carpenter ..... B67D 1/0051 222/129.4
8,181,429 B2 * 5/2012 Iwashita ..... B65B 55/10 53/425
9,724,868 B2 * 8/2017 Chauvin ..... B29C 49/4289
2002/0083682 A1 * 7/2002 Edwards ..... B65B 55/025 53/426
2002/0092866 A1 * 7/2002 Newman ..... B67D 1/0028 222/146.6
2007/0062160 A1 * 3/2007 Stadlmayr ..... A23L 2/54 53/403
2010/0275556 A1 11/2010 Michelli et al.
2011/0131933 A1 * 6/2011 Livingston ..... B67B 3/20 53/490

FOREIGN PATENT DOCUMENTS

| | | | | |
|---|---|---|---|---|
| DE | 39 27 491 | A1 | 2/1991 | |
| DE | 10 2012 013 320 | A1 | 2/1993 | |
| DE | 41 26136 | A1 | 2/1993 | |
| DE | 195 38 023 | B4 | 4/1996 | |
| DE | 19606465 | | 10/1997 | |
| DE | 19806520 | | 8/1999 | |
| DE | 199 11 517 | A1 | 9/2000 | |
| DE | 10008426 | | 8/2001 | |
| DE | 100 64 954 | A1 | 6/2002 | |
| DE | 103 22 556 | | 4/2004 | |
| EP | 0965524 | | 12/1999 | |
| EP | 2604571 | | 6/2013 | |
| GB | 1027597 | | 4/1966 | |
| JP | S61-115879 | | 6/1986 | |
| JP | H08-113291 | | 5/1996 | |
| JP | H08-282789 | | 10/1996 | |
| JP | H11-035003 | | 9/1999 | |
| NL | 8701293 | | 1/1989 | |
| WO | WO 2010/073118 | | 7/2010 | |
| WO | WO-2010106546 | A1 * | 9/2010 | ..... A23G 3/0008 |

OTHER PUBLICATIONS

European Patent Application No. 15162338.6, Extended European Search Report, 12 pages, dated Jan. 19, 2016.
International Search Report dated Apr. 4, 2014 from corresponding priority German application DE 10 2014 104 873.3.
Office Action issued in related European Patent Application No. 15162338.6 dated Dec. 8, 2017.
Official Notification of Reason for Rejection, Japanese Patent Application No. 2015-077713, dated Jan. 28, 2019 (English translation is included), 8 pages.
Office Action, European Patent Application No. 15 162 338.6-1017, dated Mar. 4, 2019, 5 pages.

* cited by examiner

METHOD AND DEVICE FOR FILLING A CONTAINER

CROSS REFERENCE TO RELATED APPLICATIONS

This application claims priority from German Patent Application No. DE 10 2014 104 873.3, filed on Apr. 4, 2014 in the German Patent and Trademark Office, the disclosure of which is incorporated herein by reference in its entirety.

BACKGROUND

Technical Field

The present invention relates to filling a container with a filling product in a beverage bottling plant, for example, for bottling a carbonated filling product, such as beer, soft drinks or mineral water, for example.

Related Art

A large number of different methods and devices for bottling filling products in beverage bottling plants are known. In order to bottle carbonated filling products, such as beer, mineral water or soft drinks, for example, it is known for example to pressurize the container to be filled to a positive pressure by way of a pressurizing gas before it is filled with the respective filling product, and only then to fill the filling product into the container pressurized in such a way. The pressurizing gas used here is, for example, $CO_2$. Accordingly, while it is filled into the container to be filled, the $CO_2$ bound in the carbonated filling product is filled in counter to the increased $CO_2$ pressure so that liberation of the $CO_2$ from the filling product can be reduced or completely prevented. This method is also referred to as the counterpressure filling method. In this way, foaming of the filling product in the container to be filled can be reduced or avoided, and so the filling operation as a whole is sped up in this way.

Usually, before the container to be filled is pressurized with the pressurizing gas, the container is first of all evacuated, then purged with the pressurizing gas, and then evacuated again in order then to be brought to the corresponding pressurizing pressure by way of the pressurizing gas before the actual filling operation, before the filling product is fed in. As a result of the evacuation and purging, a defined gas atmosphere can be created in the container, in particular, a largely oxygen-free atmosphere which is desired specifically in the case of beer or other oxygen-sensitive products.

Depending on the configuration of the counterpressure method, a filling level correction can also be carried out in a pressurized and filled container in that the filling product is pushed back into the filling-product reservoir via a return gas pipe which dips into the filling product filled into the container. This can be achieved for example by further subjecting the filled container to a pressurizing gas, for example $CO_2$, under increased pressure. The filling product is then accordingly pushed out of the container via the return gas pipe until the return gas pipe no longer dips into the filling product and accordingly the pressurizing gas escapes from the filled container into the filling-product reservoir directly via the return gas pipe.

As a result of the provision of the return gas pipe in such a counterpressure filling method, the interior of the container and the pressure in the gas space over the filling product in the filling-product reservoir can be kept at the same positive pressure level, while the filling product flows into the container.

Also known is what is referred to as a vacuum filling method, in which still liquids are introduced into a pre-evacuated container to be filled. Exact filling-level correction takes place in such a way that a suction pipe dips into the container filled with the filling product and the filling product is drawn back out of the container by way of a negative pressure applied to the suction pipe until the desired filling level, which is defined by the bottom edge of the suction pipe, is reached. The suction pipe is in this case fluidically connected to the negative pressure applied above the filling product in the filling-product reservoir, such that the liquid can be sucked out quickly and the filling product can be held in the suction pipe in a droplet-free manner. Examples of such vacuum fillers can be found in DE 83 08 618 U1 and DE 83 08 806 U1.

Vacuum fillers, such as the Krones types VV, VVHK, VVHL, for example, allow a correction phase following completion of the filling phase. In this case, the vacuum applied in the ring bowl is connected to a return air pipe. The filling level can be controlled via the dipping level of the return air pipe into the respective container to be filled. By the return air pipe being fluidically connected to the vacuum in the ring bowl, the filling product present at the bottom end of the return air pipe is accordingly sucked back into the ring bowl. In this case, losses of flavor and/or alcohol can unfavourably occur, for example during the bottling of spirits.

As a result of the provision of the suction pipe in a vacuum filling method, the container interior and the space located above the filling product in the filling-product reservoir can be brought to the same negative pressure level.

The vacuum filling devices or vacuum filling methods were not used for bottling carbonated beverages, since on account of the applied negative pressure or the applied vacuum, the $CO_2$ in the respective carbonated beverages would be immediately liberated and accordingly a filling operation having a very high foaming tendency and thus a long filling time would result. Accordingly, the filling of carbonated filling products by way of vacuum filling methods was ruled out in the prior art.

DE 199 11 517 A1 discloses a beverage bottling machine in which $CO_2$-free, i.e. non-carbonated, beverages can be bottled in containers. In order to achieve sterility and protection against oxygen of the bottled $CO_2$-free beverage, the filling stations of the beverage bottling machine run in an evacuated interior of the filler housing. The containers are evacuated just by introducing the respective container into the filler housing. In other words, the containers are evacuated by the negative pressure prevailing in the filler housing, then supplied to the respective filling locations and then filled. Since the containers are introduced into the interior of the filler housing via a transfer wheel and discharged from the filler housing after being filled, the negative pressure that is achievable in the filler housing is very limited.

Bottling a filling product in a pressurized container is also known in order to maintain sterility, as described for example in DE 41 26 136 A1.

SUMMARY

Methods and devices for filling a container with a filling product, such as a carbonated filling product, are provided. The methods and devices exhibit an improved filling behavior.

Accordingly, a method for filling a container with a filling product in a beverage bottling plant is described, which includes the provision of the filling product under a positive pressure and the evacuation of the container to be filled in order to achieve a negative pressure. According to the present disclosure, the filling product, which is under positive pressure, is fed into the container, which is under negative pressure.

As a result of the filling product, which is under positive pressure, being fed into the container, which is under negative pressure, the flow of the filling product into the container can be sped up. In particular, abrupt filling of the container to be filled with the filling product is possible in this way.

On account of the negative pressure in the container to be filled, during the filling of the container, first of all no gas is displaced from the container interior, but rather only the negative pressure is reduced. Accordingly, no fluid flow directed counter to the filling product flowing in takes place and in particular no gas is displaced out of the container to be filled by the filling product, said gas then having to flow out through the mouth of the container. Accordingly, in order to fill the container, the entire mouth cross section is available for the filling product to flow in. In the prior art, the return gas pipe required for this purpose disadvantageously also takes up part of the maximum available free mouth cross section of the container.

In conventional filling methods, for example the counter-pressure method, it is by contrast necessary for the gas displaced out of the container by the filling-product flow flowing in to escape through the mouth again at the same time as the filling product flows in. Accordingly, two fluid flows that are directed in opposite directions share the mouth cross section of the container to be filled, specifically on the one hand the fluid flow directed into the container of the filling product, and on the other hand, the fluid flow directed out of the container of the displaced gas.

In a vacuum filling method, the entire mouth cross section is likewise not available, since the return gas pipe, via which a filling level correction, as is known from the prior art, is carried out, is guided through the mouth cross section. Thus, two fluid flows in opposite directions are provided in a vacuum filling method according to the prior art, too, specifically on the one hand the filling-product flow flowing into the container to be filled and the return gas flow or vacuum flow, directed in the opposite direction, through the return gas pipe, said return gas flow or vacuum flow then being replaced in the correction phase by the filling-product flow flowing back.

In exemplary embodiments, before the filling product is fed in, the container is evacuated to a negative pressure at an absolute pressure of about 0.5 bar to 0.05 bar, in a further embodiment about 0.3 bar to 0.1 bar, and in another embodiment about 0.1 bar. On account of the filling product being filled into a corresponding negative pressure in the container, the interior of the container has been evacuated such that, during filling with the filling product, no gas is displaced by the filling product and accordingly no gas also has to flow out of the interior of the container. Rather, the entire mouth cross section of the container can be used for the filling product to flow in. In other words, only a filling-product flow directed into the container occurs here. The filling of the filling product into the container is furthermore supported by the provided pressure difference between the negative pressure in the container to be filled and the positive pressure in the filling-product reservoir.

In a further advantageous configuration of the method, the filling product is provided under a positive pressure which corresponds to the ambient pressure, for example under an absolute pressure of 1 bar. The positive pressure is accordingly in the form of a positive pressure compared with the negative pressure in the container, and so there is a pressure gradient between the provided filling product and the container.

The positive pressure can also correspond to the saturation pressure of the filling product and in some embodiments, be at an absolute pressure of about 1.1 bar to 6 bar. As a result of the positive pressure at the respective saturation pressure, liberation of the $CO_2$ from a carbonated filling product can be counteracted.

In a development, the positive pressure is above the saturation pressure of the filling product and is in some embodiments, at an absolute pressure of about 1.6 bar to 9 bar. As a result of a high positive pressure, which is in particular above the saturation pressure of the filling product, it is possible for the $CO_2$ in the filling product to be in saturation and at the same time for the pressure gradient between the provided filling product and the container to be even greater in order to speed up the filling operation even more.

Via the pressure gradient provided between the filling product and the container, abrupt filling of the container can be achieved. In this case, a conventional beer bottle can be filled with the filling product in about 0.3 seconds, for example, compared with the conventional filling time of about 4.5 seconds. In this case, the abrupt filling takes place substantially at the start of the filling operation. Towards the end of the filling operation, when the container is already largely filled with the filling product, equalization of the pressures between the pressure in the headspace of the container and the pressure of the filling product provided under positive pressure can take place, since the residual gas in the container can now rise to atmospheric pressure or to the pressure provided by the filling product. However, the pressure difference achieved or the equalization of the pressures depends on the starting pressures and in particular on the initial negative pressure in the container to be filled.

In other words, the pressure progression in the container to be filled during filling is dependent on the pressure in the container to be filled at the start of the filling operation and thus also on the residual gas in the container. By way of the filling product, the container is filled such that the filling product shares the remaining space with the residual gas. Accordingly, the pressure in the container rises. From the resulting pressure curve, it is therefore also possible to determine the respective filling state of the container and for example also to determine the end of filling to be reached on this basis.

In order to achieve particularly hygienic and low-oxygen filling of the filling product into the container to be filled, the container to be filled is in some embodiments already initially evacuated once prior to the actual evacuation for filling the container with the filling product, and then purged with a purge gas, whereupon the container is then evacuated again to the abovementioned negative pressure and then the filling product is filled into the container thus evacuated. In this way, it is possible for the residual gas in the container to be a largely defined gas, for example $CO_2$, in order to allow the container to be filled in a defined atmosphere and in particular in a low-oxygen atmosphere. As a result, an extended storage time can be achieved and thus even oxygen-sensitive products, such as beer, for example, can be bottled.

In certain embodiments, after the filling product has been fed in, the filled container is subjected to a pressurizing gas at an absolute pressure of about 2 bar to 9 bar, in some embodiments at an absolute pressure of about 3.5 bar to 7 bar, and in other embodiments at an absolute pressure of about 3.8 bar to 5.5 bar. In this case, the pressurizing gas used can be an inert gas, for example $CO_2$.

When the filled container is subjected to a pressurizing gas under increased pressure, for example to $CO_2$, filling-product foam in the headspace of the filled container can be forced back and pushed into the container. Furthermore, the filling-product line can be emptied of foam and residual filling product. Moreover, as a result of the container being subjected to the pressurizing gas, renewed binding or dissolving of the $CO_2$ in the filling product can be favored such that the settling time for the filling product in the filled container can be reduced and accordingly the filled container can be prepared for discharging or capping.

The positive pressure of the pressurizing gas to which the filled container is subjected after the filling product has been fed in some embodiments corresponds to the positive pressure at which the filling product is provided.

By way of the mentioned method, carbonated beverages are typically bottled. Contrary to the preconception in the prior art that it is not possible to fill a container to be filled with a carbonated filling product when the container exhibits a negative pressure or a vacuum, abrupt filling of the container with a filling product is possible by way of the method described here when the container is under a negative pressure or exhibits a vacuum and the filling-product reservoir is under a positive pressure.

In order to shorten the settling time of the filling product in the filled container and to prevent the filling product from foaming or foaming over when the container is brought to ambient pressure after filling, the filled container is usually capped without an exchange of the container interior with the environment taking place. In some embodiments, the filled container is capped after being filled and optionally after the container has been subjected to a pressurizing gas, without the pressure conditions in the headspace of the filled container being changed and in particular without the filled container being brought into contact with the environment.

After being filled with the filling product, the container is capped, generally without depressurization of the container to ambient pressure, in order to prevent the filling product from foaming, running over or shooting out. Thus, it is not necessary to wait for the filling product to settle, but rather capping can be carried out directly. The filled container is in this case capped in one embodiment at a positive pressure at an absolute pressure of about 2 bar to 9 bar, in a further embodiment at a positive pressure at an absolute pressure of about 2.5 bar to 6 bar, or at a positive pressure which corresponds to the saturation pressure of the filling product, which in certain embodiments is at an absolute pressure of about 1.1 bar to 6 bar, or at a positive pressure which is above the saturation pressure of the filling product, which in some embodiments is at an absolute pressure of about 1.6 bar to 9 bar. The positive pressure at which the filled container is capped is typically the positive pressure provided by the pressurizing gas.

The actual capping of the filled containers can be carried out with well-known caps by means of well-known cappers. The filled containers can accordingly be capped for example with crown caps, stoppers, screw caps or roll-on caps.

Evacuation of a soft-wall container, for example a polyethylene terephthalate (PET) container or some other thin-walled plastics container, is enabled in that the container is introduced into an evacuable chamber and the chamber is likewise evacuated before or during the evacuation of the container to be filled. To this end, either a filler chamber can be evacuated or a separate space enclosing the respective container can be provided, said space allowing evacuation such that the pressure conditions on the inner side and on the outer side of the evacuated container to be filled are identical. Accordingly, it is also possible to subject soft-wall containers to filling by way of the described method.

In some embodiments, before being evacuated, the container is connected in a fluid-tight manner to a filling-product line for supplying the vacuum, the pressurizing gas and the filling product.

Generally, at least one flavoring and/or a beverage additive and/or a beverage ingredient is metered into the interior of the plastics container before and/or during and/or after the feeding of the filling product into the interior of the plastics container. Beverage additives are understood here as including syrup and/or preservatives.

As a result of the flavoring and/or the beverage additive and/or the beverage ingredient being metered into the interior of the plastics container, flexible metering in of flavorings and/or beverage additives and/or beverage ingredients can be achieved, this making a rapid change between different flavorings and flavors possible. As a result of the rapid filling operation, as described above, a part of the treatment angle in a carousel filler can be taken up by other functions. Accordingly, the above-described method makes it possible to additionally provide a flavoring metering means for metering in flavorings and/or beverage additives and/or beverage ingredients, and so an advantageous change between different flavors becomes possible.

A device for filling a container with a filling product by the above-described methods is also described, which includes a filling-product supply for supplying the filling product and a filling-product line which is able to be brought into contact in a fluid-tight manner with the container to be filled, a vacuum device for evacuating a container to be filled and furthermore a control device. According to the present disclosure, the control device is designed first of all to evacuate the container by means of the vacuum device and then to introduce the filling product into the evacuated container.

In some embodiments, provision is made of a capper by means of which the filled container is cappable without depressurization of the container to ambient pressure. In this way, depressurization of the filled container can be avoided and thus the filling operation can be sped up, since it is not necessary to wait for the filling product to settle prior to capping in order to avoid the filling product foaming over, shooting out and running over. Rather, capping takes place under the same conditions, in particular at the same pressure conditions, as filling.

The actual capping of the filled containers can be carried out with well-known caps by means of well-known cappers. The capper can accordingly be for example a crown capper, a stopper capper, a screw capper or roll-on capper.

Advantageously, provision is made of a capping head which has a capping-head space that is sealed off from the environment, said capping-head space accommodating the filling-product line and a capper together with the mouth of the container. In some embodiments, the capping-head space is openable and closable in order to accommodate the container, and generally has two capping-head jaws which are openable and closable in order to accommodate the container and in various embodiments to supply a container cap. By way of such a capping head, filling and capping can be carried out in the same gas atmosphere and at the same pressure in the capping-head space.

The filling-product supply is advantageously subjectable to a positive pressure and is in one embodiment configured as a filling-product reservoir having a gas space which is present above a filling-product level and is under pressure or as a line which is filled with the filling product and is under pressure, which in some embodiments is a voidlessly filled line which is under pressure.

In an advantageous embodiment, the filling-product line has the same cross section as the mouth cross section of the container to be filled, and in particular the entire mouth cross section of the container to be filled is usable for filling the filling product into the latter. By using the entire cross section of the mouth, particularly quick filling of the filling product into the container can be achieved.

In a further advantageous embodiment, a flavoring metering means for metering a flavoring and/or a beverage additive and/or a beverage ingredient into the interior of the plastics container is provided. The flavoring metering means can be for example in the form of a peristaltic pump, by means of which the flavoring and/or the beverage additive and/or the beverage ingredient is pumped from a corresponding reservoir and metered in.

A filling plant for bottling a filling product in a container is further described, which includes a filler having filling stations for filling the containers with the filling product according to the above-described method and a capper, arranged downstream of the filler, having capping stations for capping the filled containers. According to the present disclosure, the number of filling stations corresponds substantially to the number of capping stations.

Accordingly, cappers and fillers can have the same dimensions and in certain embodiments be integrated with one another. Such an arrangement is allowed by the substantially increased filling speed of the method, since the timescales for filling the containers to be filled and for capping the containers to be filled approximate to one another.

In this way, a compact filling plant can be constructed, since on account of the possibility of abruptly filling the containers by way of the proposed method, the filling operation can proceed in a similarly quick manner to the capping operation.

In this way, a much more compact filling plant can be provided than those known from the prior art, in which the number of filling stations is much greater than the number of capping stations.

In one embodiment, the number of filling stations corresponds to 1 to 3 times, generally 1 to 2 times, the number of capping stations. The capper can thus be configured to be only marginally smaller than the filler.

In another embodiment, the number of capping stations corresponds to 1 to 3 times, typically 1 to 2 times, the number of filling stations. The filler can thus be configured to be smaller than the capper. This configuration, too, can be realized on account of the much shorter filling times.

BRIEF DESCRIPTION OF THE DRAWINGS

Further embodiments and aspects of the present invention are explained in more detail by the following description of the figures.

DETAILED DESCRIPTION

Examples of embodiments are described in the following text with reference to the figures. Here, identical, similar or functionally identical elements are designated by identical reference signs in the various figures and a repeated description of these elements is to some extent dispensed with in the following description, in order to avoid redundancies.

Figure 1:
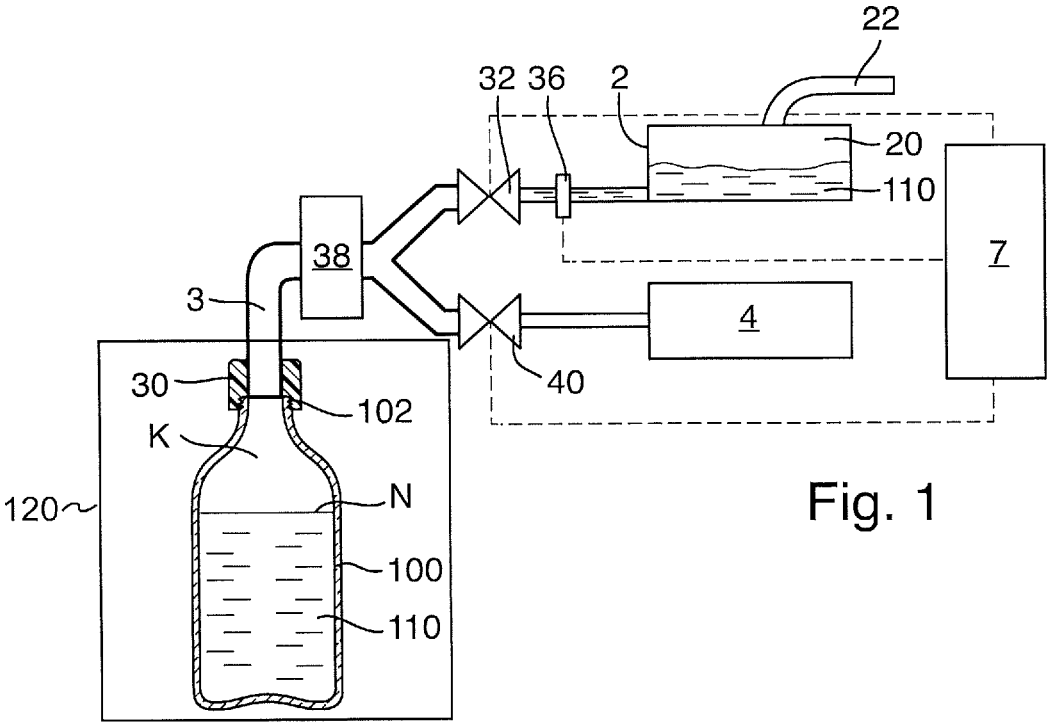
FIG. 1 shows a schematic illustration of a device for filling a container with a filling product.

FIG. 1 schematically shows a device 1 for filling a container 100 with a filling product 110 in an evacuable chamber 120. The filling product 110 to be bottled is accommodated in a filling-product supply arranged above the container 100, said filling-product supply being in the form of a filling-product reservoir 2 which may be provided for example in the form of a center bowl or of a ring bowl of a carousel filler. The filling product 110 is located in the lower part of the filling-product reservoir 2 such that a gas space 20 is formed above the filling product 110 in the filling-product reservoir 2.

Depending on the respective filling product 110 to be bottled, an appropriate gas or gas mixture is present in the gas space 20. For example, in the case of a carbonated beverage to be bottled, the gas space 20 may contain $CO_2$, which is generally under positive pressure, with the result that the $CO_2$ bound in the carbonated beverage is not liberated. Furthermore, the oxygen can be displaced from the gas space 20 by the $CO_2$, such that scarcely any oxygen or no oxygen is present in the filling-product reservoir 2, this being generally in the case of oxygen-sensitive filling products such as beer, for example. When still beverages are bottled, it is also possible for a different inert gas to be present in the gas space 20, this allowing a particularly gentle handling of the filling product 110.

A filling-product line 3, which includes a centering bell 30, is schematically shown in the figure. The container 100 to be filled is pressed against the centering bell 30 in a sealing manner by way of its mouth 102, such that a gastight and liquid-tight connection is formed. Accordingly, a gastight and liquid-tight connection exists between the filling-product line 3 and the interior of the container 100 by means of the centering bell 30.

Via a filling-product valve 32, the filling product 110 can pass from the filling-product reservoir 2 via the filling-product line 3 and into the interior of the container 100. The filling-product valve 32 controls the start and end of filling such that the container 100 is filled with a predetermined quantity of filling product 110.

The end of filling and thus the closing of the filling-product valve 32 can be determined for example by the reaching of a predetermined filling level N in the container 100, by the reaching of a predetermined filling weight and/or by the reaching of a predetermined filling volume. As a further possibility, provision can also be made of a metering chamber into which the filling product is pre-metered and then is likewise present in this metering chamber under the positive pressure. When the metering chamber has been emptied, the filling operation ends.

As a further possibility for determining the end of filling, the pressure progression in the container 100 to be filled can be taken into consideration during the operation of filling with the filling product 110 and the filling operation and the end of filling can be controlled on the basis of the pressure progression. For example, the end of filling can be reached when a particular pressure in the interior of the container 100 is exceeded. To this end, a pressure sensor 38 which monitors the pressure conditions in the container 100 during the filling operation can be provided in the filling-product line 3.

A flow control valve 36 by means of which the maximum flow rate with the filling-product valve 32 opened can be controlled can be provided upstream of the filling-product valve 32 in the product-conducting line. By means of the flow control valve 36, the course of the filling operation can be influenced deliberately and for example only a reduced flow can be provided towards the end of the filling operation, in order for example to allow the end of filling to be reached in a precise manner.

Provision is furthermore made of a vacuum device 4 which is likewise able to be brought into communication with the filling-product line 3, and thus also with the interior of the container 100, via a vacuum valve 40. By means of the vacuum device 4, the interior of the container 100 can be evacuated and accordingly the gas in the interior of the container 100 pumped out. The pressure that is able to be provided in the interior of the container 100 by way of the vacuum device 4 is in one embodiment at an absolute pressure of about 0.5 bar to 0.05 bar, in a further embodiment about 0.3 bar to 0.1 bar, and in another embodiment about 0.1 bar. Accordingly, a large part of the gas located in the container interior can be pumped out by means of the vacuum device 4.

The gas space 20 of the filling-product reservoir 2 is subjectable to a positive pressure via a pressure line 22, such that the filling-product reservoir 2 as a whole is under pressure. The gas accommodated in the gas space 20 of the filling-product reservoir 2 is typically an inert gas and in certain embodiments $CO_2$, in particular when the filling product 110 is a carbonated beverage, for example beer, a soft drink or mineral water.

When the filling product 110 is a carbonated filling product, such a pressure can be provided in the gas space 20 above the filling product 110 by the supply of $CO_2$ via the pressure line 22 that the $CO_2$ is prevented from being liberated from the filling product 110. Provision is generally made here of an absolute pressure of about 1 bar to 9 bar, in one embodiment an absolute pressure of about 2.5 bar to 6 bar, and in another embodiment, an absolute pressure of about 2.8 bar to 3.3 bar is maintained in the gas space 20.

In one embodiment, the filling product 110 is provided in the filling-product reservoir 2 at a positive pressure that corresponds to the ambient pressure, generally at an absolute pressure of 1 bar. The filling product 110 can also be provided in the filling-product reservoir 2 at a positive pressure that corresponds to the saturation pressure of the filling product 110, such as at an absolute pressure of about 1.1 bar to 6 bar. In a further embodiment, the filling product 110 can also be provided in the filling-product reservoir 2 at a positive pressure that is above the saturation pressure of the filling product 110, such as at an absolute pressure of about 1.6 bar to 9 bar.

By means of the vacuum device 4, which is able to be brought into fluid connection with the interior of the container 100 via the filling-product line 3, the container 100 can be evacuated prior to the actual operation of filling with the filling product 110. To this end, when the vacuum valve 40 has been opened, the gas which is located in the container 100 is drawn off via the vacuum device 4. When the container 100, for example coming from the ambient atmosphere, is connected to the centering bell 30 the ambient air located in the container 100 is drawn off via the vacuum device 4. If the container 100 has already been subjected to a gas atmosphere, for example an inert gas or $CO_2$, the vacuum device 4 accordingly pumps this gas atmosphere out of the container 100. The vacuum device 4 is generally configured such that it can provide a considerable negative pressure, for example in the region of an absolute pressure of about 0.5 bar to 0.05 bar, in the container 100.

The valves, in particular the filling-product valve 32 and the vacuum valve 40, are actuated via a control device 7. The control device 7 can be embodied either as an analogue controller or expediently as a programmed controller, for example in the form of a PC or industrial PC. The control device 7 can also be a module of the overall plant controller of a carousel filler, of a carousel capper or of a filling plant.

The control device 7 is designed to carry out the method described below and is in particular programmed to carry out this method and to control the corresponding plant components. Accordingly, the valves and components are actuated one after another such that the method proceeds in the form described.

In some embodiments, but not shown in the figures, the control device 7 is connected to sensors and transducers which monitor for example the pressure conditions in the container 100 or in the filling-product line 3 connected to the container 100 and in the filling-product reservoir 2.

The filling method which can be carried out by means of the device 1 according to FIG. 1 provides first of all for the filling-product reservoir 2 or the gas space 20 of the filling-product reservoir 2 to be subjected to a positive pressure. The positive pressure can be provided for example by the supply of a corresponding gas under pressure via the pressure line 22.

In an embodiment that is not shown in the figure, the filling-product supply 2 can also be provided in the form of a line in which the filling product 110 is conducted under pressure. Use can in some embodiments be made here of what is referred to as a voidlessly filled line, e.g., a line that is filled completely and without a gas space.

In order to fill a container 100 with the filling product 110, the interior of the container 100 is evacuated via the vacuum device 4 with the filling-product valve 32 closed and the vacuum valve 40 opened and accordingly brought to a negative pressure. Once the predetermined negative pressure, for example about 0.1 bar, in the container 100 has been reached, the vacuum valve 40 is closed and the filling-product valve 32 opened. On account of the large pressure difference between the interior of the container 100, in which a negative pressure prevails, and the filling-product reservoir 2, in which a positive pressure prevails, the container 100 is abruptly filled with the filling product 110. The filling operation can thus be carried out very quickly and is accordingly also ended quickly.

Since, during the filling operation, on account of the negative pressure already provided in the container 100, no gas is displaced out of the container 100, at least in the first phase of filling, when the filling product 110 flows in, but rather only the negative pressure is reduced, the filling product can also flow into the container 100 via the entire mouth cross section d of the mouth 102 of the container 100.

In this way, when the container 100 is being filled with the filling product 110, the filling operation can be effected, at least over the greatest part of the filling operation, with a fluid flow in only one direction, namely a fluid flow which is directed only into the container 100. No counterflow of fluid, for example of a gas, takes place, since no displacement of gas out of the container 100 into the filling-product line 3 and/or into the filling-product reservoir 2 takes place. Rather, as a result of the filling of the container 100 only the negative pressure in the container 100 is slowly reduced. Only towards the end of the filling operation, when the pressure slowly rises in the headspace K of the container 100, i.e., the space located above the filling level N of the filling product 110 in the container 100, and possibly the pressure conditions in the container 100 are equalized with the pressure conditions in the filling-product line 3, will the inflow of the filling product 110 out of the filling-product reservoir 2 slow down.

Depending on the respective negative pressure provided in the container 100, such slowing down can be avoided, however. The lower the pressure in the container 100 to be filled, the less significant the slowing down will turn out to be, since at a lower pressure of the container 100 to be filled, a significant negative pressure still prevails in the container 100 even at the time that the filling-product valve 32 is closed.

Therefore, the time at which slowing down occurs depends on the negative pressure in the container 100 and thus on the design of the vacuum device 4. The lower the pressure in the container 100 is, the later equalization of the pressure conditions occurs; or, in the extreme case of a particularly high vacuum in the container 100, equalization of the pressure conditions does not occur at all, but rather a negative pressure will still exist in the headspace K even when the desired filling level N has already been reached and the filling-product valve 32 has already been closed.

The positive pressure in the filling-product reservoir 2 remains substantially constant over time. By contrast, during filling, the pressure in the container 100 rises on account of the filling product 100 flowing in. If the negative pressure in the container 100 to be filled is selected such that towards the end of the filling operation the pressure in the container 100 and in particular in the headspace K has exceeded a particular level, regulation of the filling-product flow flowing into the container 100 can be achieved as a result of the rising pressure. Accordingly, the filling-product flow slows down towards the end of the filling operation, such that the reaching of an end of filling can be easily supported and the filling-product valve 32 can then be closed.

Accordingly, by means of the device 1 shown in FIG. 1 for filling a container 100 with a filling product 110, very quick, abrupt bottling of the filling product 110 into the container 100 can be achieved in that a large pressure gradient exists between the filling-product reservoir 2 and the interior of the container 100 and thus a high flow velocity can be achieved, since the filling product is so to speak pressed (from the point of view of the filling-product reservoir 2) and sucked (from the point of view of the container 100) into the container 100 as a result of the pressure gradient. At the same time, the negative pressure in the container 100 to be filled ensures that a fluid flow directed only into the container 100 exists and no gas flow in the opposite direction occurs, and so the filling of the container can be carried out with the entire mouth cross section d of the mouth 102 of the container being utilized.

As a result, it is possible to achieve the filling of the container 100 in very short filling times, for example when a conventional 0.5 L beer bottle is filled in a filling time of 0.3 seconds. By comparison, the filling times for an identical beer bottle in the counterpressure method are in the region of 4.5 seconds on account of a hydrostatic pressure. Accordingly, abrupt filling of the container 100 to be filled can be achieved with the described method, and so the filling process as a whole can be carried out more quickly. This can result either in greater capacity for a given filler size, or a filler, for example a rotary filler, can be configured with smaller dimensions and a reduced number of filling stations.

In various embodiments, the number of filling stations corresponds substantially to the number of capping stations. In one embodiment, the number of filling stations corresponds to 1 to 2 times the number of capping stations. In this way, a particularly compact filling plant can be provided.

Figure 2:
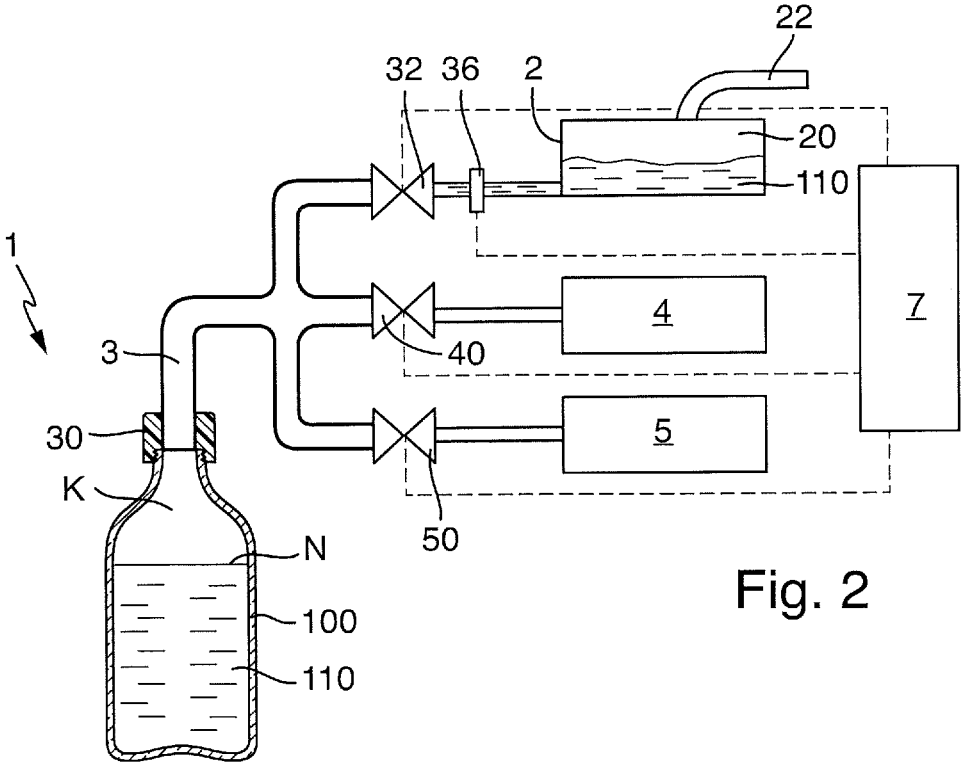
FIG. 2 shows another schematic illustration of a device for filling a container with a filling product.

FIG. 2 shows an embodiment of the device 1, wherein, in addition to the filling-product reservoir 2, which is connected to the filling-product line 3 via the filling-product valve 32, and the vacuum device 4, which is connected to the filling-product line 3 via the vacuum valve 40, provision is furthermore made of a pressurizing-gas device 5 which is likewise connectable to the filling-product line 3 via a pressurizing-gas valve 50. The pressurizing-gas valve 50, too, can be actuated by means of the control device 7. The control device 7 is set up such that the described method takes place.

By means of the pressurizing-gas device 5, with the pressurizing-gas valve 50 opened, $CO_2$, for example, can be introduced into the container 100 via the filling-product line 3. The pressurizing gas used can also be some other inert gas. The pressurizing gas can be applied to the filled container 100 at an absolute pressure of about 2 bar to 9 bar, generally at an absolute pressure of about 3.5 bar to 7 bar, and in some embodiments at an absolute pressure of about 3.8 bar to 5.5 bar.

In some embodiments, the pressurizing-gas device 5 is connected to the gas space 20 of the filling-product reservoir 2. The gas to be supplied to the container 100 in this way is accordingly under the same pressure as the gas accommodated in the gas space 20 and is accordingly also the same gas.

A filling method, which represents a development of the filling method described with respect to FIG. 1, first of all allows the container 100 to be evacuated by means of the vacuum device 4 by the vacuum valve 40 being opened with the filling-product valve 32 closed and the pressurizing-gas valve 50 closed. At a pressure of about 0.1 bar as a result of the evacuation, 90% of the atmospheric oxygen has accordingly been removed from the container 100. Once the desired negative pressure in the container 100 has been achieved, for example a pressure of about 0.1 bar, the vacuum valve 40 is closed and the pressurizing-gas valve 50 opened, and accordingly pressurizing gas, for example $CO_2$, is fed into the container 1 via the pressurizing-gas device 5.

Once the pressurizing gas has been fed in via the pressurizing-gas device 5, the pressurizing-gas valve 50 is closed again and the vacuum valve 40 is opened again, such that the gas mixture can again be drawn out of the container 100 via the vacuum device. In this way, when the pressure in the container 100 is again reduced to about 0.1 bar, a 99% reduction in the oxygen content in the container 100, compared with the initial state, is achieved.

Then, the container 100 evacuated in this way and accordingly under negative pressure is abruptly filled with the filling product 110 from the filling-product reservoir 2 after the vacuum valve 40 is closed and the filling-product valve 32 opened, as described with respect to FIG. 1. The filling-product valve 32 is closed when the desired filling level N in the container 100 has been reached.

In certain embodiments, after the filling-product valve 32 has been closed, the pressurizing-gas valve 50 can be opened again and pressurizing gas fed into the filling-product line 3 via the pressurizing-gas device 5. As a result, the negative pressure still present in the headspace K or in the container 100 is reduced and instead a positive pressure is built up or a positive pressure already present in the headspace K is increased further. At the same time, residual filling product located in the filling-product line 3 is pushed into the container 100 by the pressurizing gas flowing in. In particular in the case of filling a filling product 110 with a high foaming tendency, following the abrupt filling of the container 100 with the filling product it is possible for filling-product foam still to be present in the filling-product line 3 and the headspace K of the container 100. As a result of the pressurizing-gas valve 50 being opened and the filling-product line 3 and the headspace K being subjected to the pressurizing gas, this foam can be pushed back into the container 100, such that essentially no filling product, and in particular no filling-product foam, is present in the filling-product line 3 anymore.

When the container 100 or the headspace K of the container 100 is subjected to a pressurizing gas, for example $CO_2$, at increased pressure, for example at about 1.1 to 3 bar, in one embodiment at 2 bar, it is furthermore possible to prevent the liberation of a carbonated filling product 110 in the container 100, or renewed binding of $CO_2$ liberated during the filling operation can be supported by the increased pressure.

Filling is then concluded.

Figure 3:
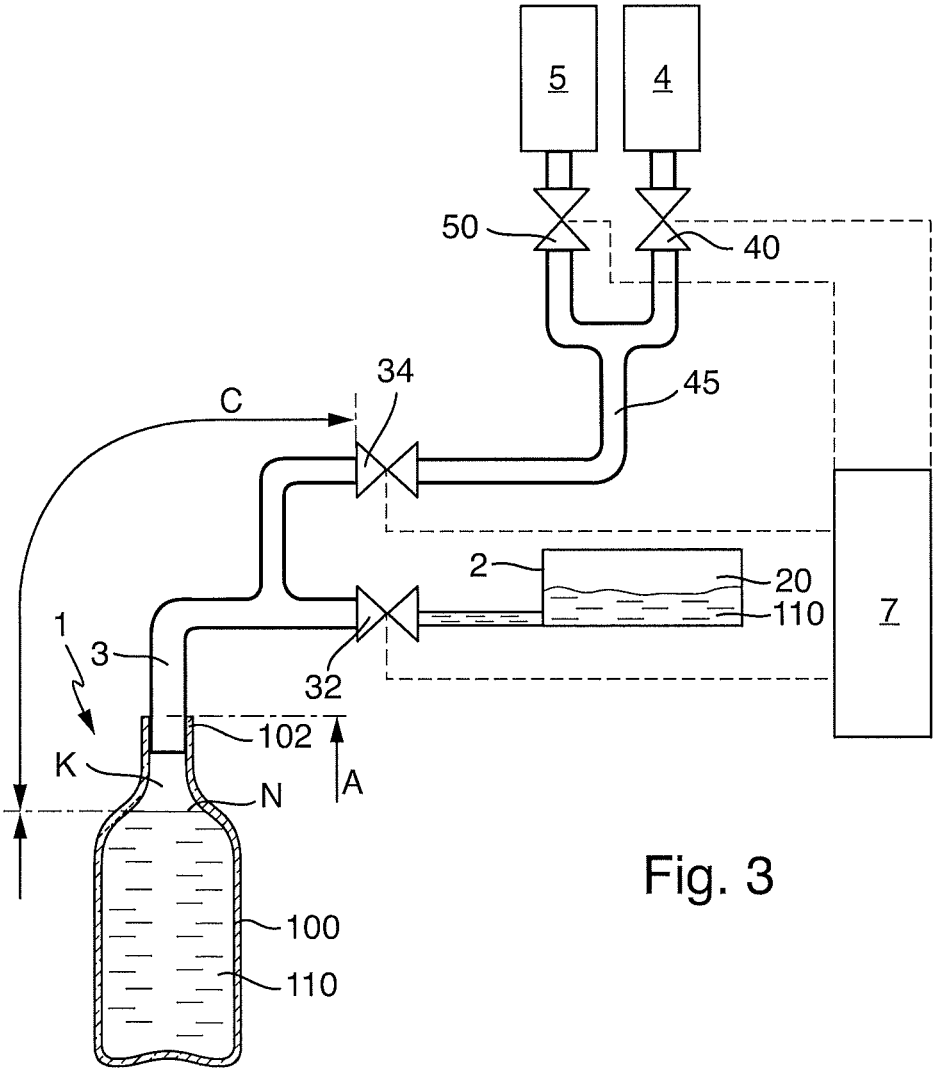
FIG. 3 shows a further schematic illustration of a device for filling a container with a filling product, having a filled container.

FIG. 3 schematically shows another device 1, the design of which is similar to that in FIG. 2. The container 100 can again be filled via the filling-product line 3 with the filling product 110 supplied from a filling-product supply in the form of the filling-product reservoir 2. Vacuum or pressurizing gas can be supplied to the container 100 via a corresponding pressurizing-gas device 5 or a vacuum device 4. The pressurizing gas and the vacuum are conducted in a combined gas line 45. Provision is made of a shut-off valve 34 which closes off the in this case combined gas line 45 of the vacuum device 4 and the pressurizing-gas device 5 from the filling-product line 3. The shut-off valve 34, too, is actuated via the control device 7. The control device 7 is accordingly designed such that the described method takes place.

This results, at a filling level N that has been reached, in a headspace K which is between the maximum filling height A of the container 100 and the filling level N. A foam space C, which corresponds to the volume between the filling level N and the filling-product valve 32 and the shut-off valve 34, is furthermore formed. Accordingly, the foam space C has a volume which corresponds to the headspace K plus the portion of the filling-product line 3 between the mouth 102 of the filled container 100 and the filling-product valve 32 and the shut-off valve 34.

The foam space C should generally be kept as small as possible in order, in the case of the abrupt filling of the container 100 with the filling product 110, for only a limited quantity of foam to be present in particular when a carbonated filling product 110 is bottled. As a result of the foam space C or the filling-product line 3 being subjected to the pressurizing gas, for example $CO_2$, from the pressurizing-gas device 5, said pressurizing gas being under positive pressure, it is accordingly possible for the foam to be pushed out of the foam space C into the container 100. By minimizing the foam space C it is possible here for all of the foam to already be pushed into the container 100 by means of a moderate predetermined positive pressure via the pressurizing-gas device 5. Furthermore, the filling precision is also increased when the foam space C contains only a moderate volume. The residual filling product located in the foam space C then only insignificantly influences the filling level N after the filling-product valve 32 is shut-off, and so precise filling becomes possible.

In some embodiments, the ratio of foam space C to the headspace K is about 1.1 to 3, for example about 2, such that it is possible to introduce all of the filling-product foam into the container 100 by feeding in the pressurizing gas.

FIGS. 4 to 7 show certain configurations of a part of a device 1 for filling a schematically indicated container 100 with a filling product. In this case, provision is made of a capping head 6 which serves for filling the container 100 and for capping the filled container 100.

The container 100 to be filled is held with its mouth region 102 against the capping head 6 in a sealed manner. To this end, the capping head 6 has a container seal 600 which accordingly comes into contact with the mouth region 102 of the container 100 in a sealing manner. The capping head 6 has a capping-head space 60 which is in communication with the interior of the container via the mouth projecting into the capping-head space 60.

Figure 7:
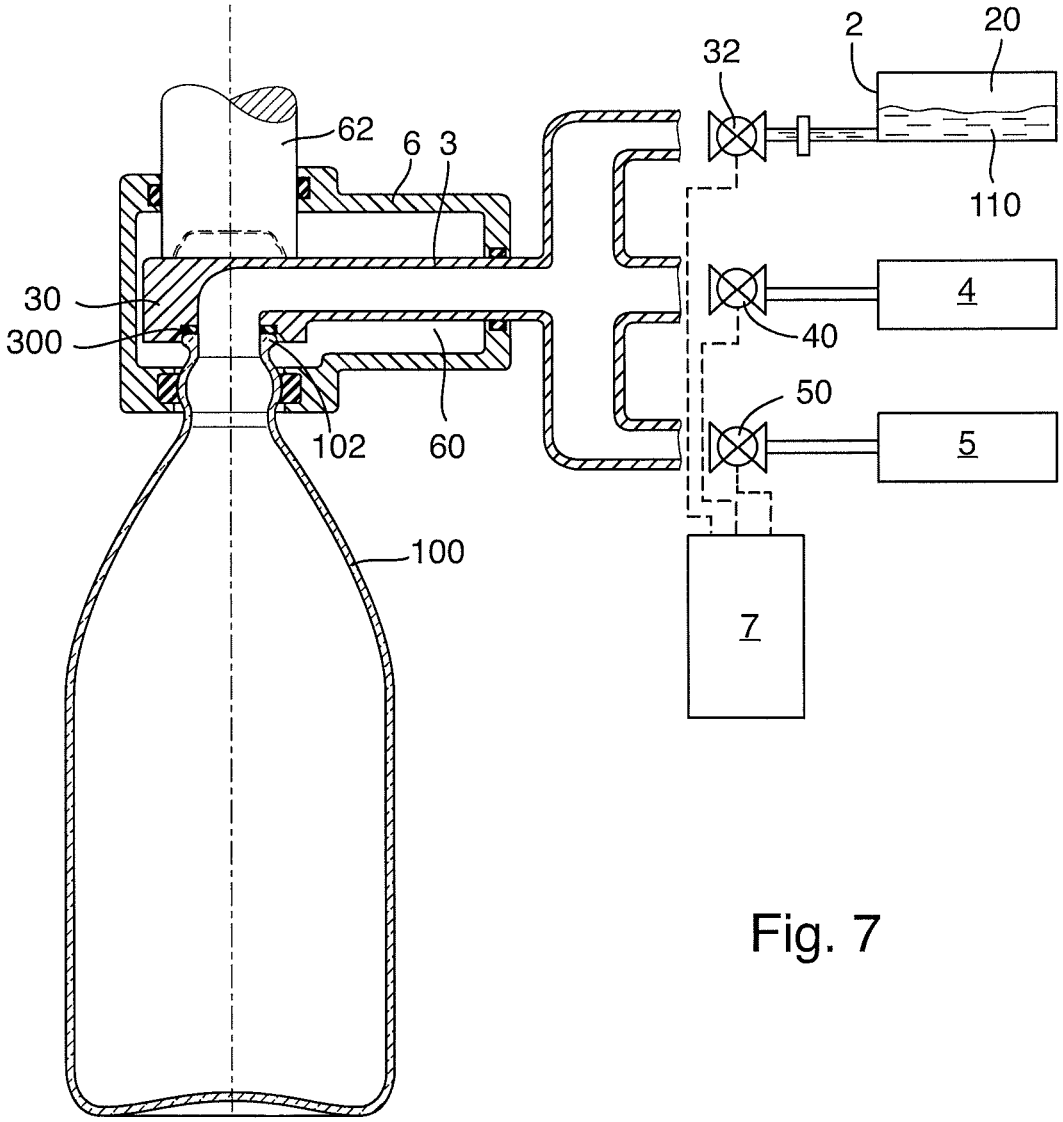
FIG. 7 shows another schematic side illustration, in partial section, of the capping head from FIGS. 4 to 6.

Provision is likewise made of a filling-product line 3 which has a centering bell 30 that has a seal 300 which is placeable in a sealing manner against the mouth 102 of the container 100 in order to provide a gastight and fluid-tight connection. Accordingly, as is shown in other embodiments in the present figures, fluid-tight and gastight sealing of the filling-product line 3 with the interior of the container 100 can be carried out. The filling-product line 3 can be displaced in the displacement direction X together with the centering bell 30 such that the filling-product line 3 is advanced together with the centering bell 30 so that it is placed in a sealing manner directly on the mouth 102 of the container 100. However, in the state shown in FIG. 4, the centering bell 30 has been retracted such that the space above the mouth 102 in the capping-head space 60 is free. The advanced position of the centering bell 30, in which the centering bell 30 rests in a sealing manner on the mouth 102, is schematically shown in FIG. 7.

The passage of the filling-product line 3 into the capping-head space 60 is sealed via filling-product-line seals 620, such that the capping-head space 60 is sealed off from the environment even when the fluid-product line 3 is displaced in the displacement direction X.

In the exemplary embodiment shown, provision is furthermore made of a capper 62 which holds a container cap 104 via a magnet 622, wherein the container cap 104 is configured in the form of a crown cap in this case. The capper 62 can be lowered and raised in the stroke direction Y, wherein the capper seals the capping-head space 60 off from the environment via a capper seal 640.

The capper 62 is arranged coaxially with the container axis 106 of the container 100 and thus also coaxially with the mouth 102 of the container 100 in order to be able to apply the container cap 104 reliably to the container 100.

Figure 5:
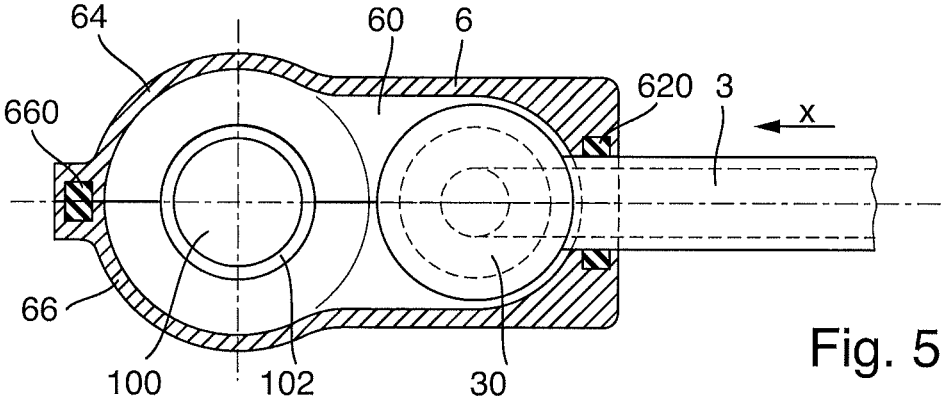
FIG. 5 shows a plan view of the capping head from FIG. 4 in a closed position.
Figure 6:
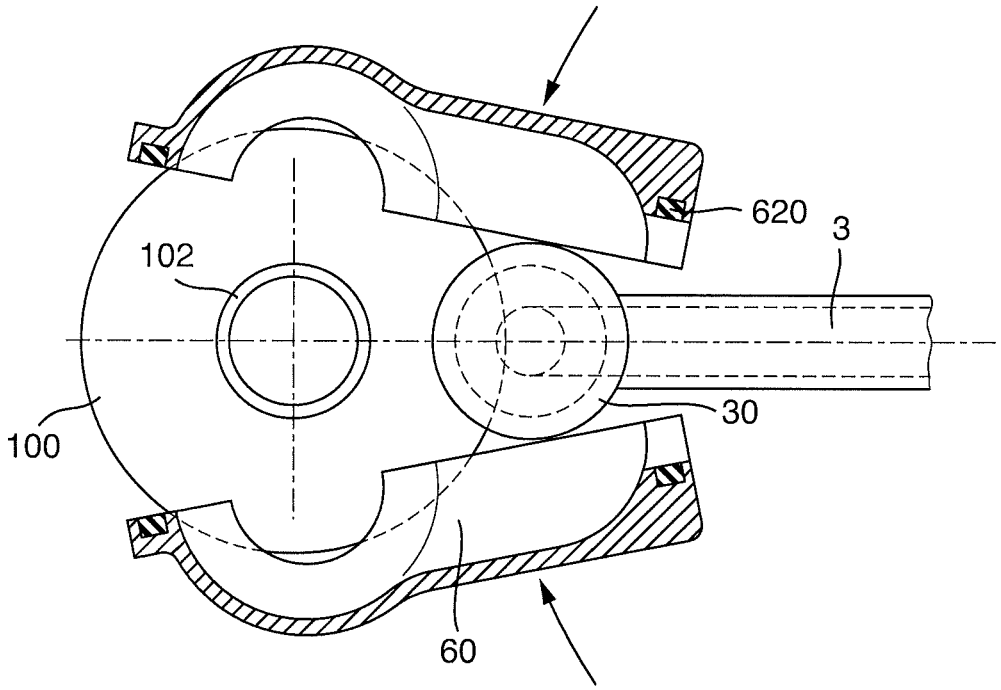
FIG. 6 shows a plan view of the capping head from FIGS. 4 and 5 in an opened position.

FIG. 5 shows the capping head 6 in plan view, wherein it can be seen that the capping head 6 has two capping-head jaws 64, 66 which can be opened and closed, as can also be gathered directly for example from FIG. 6. The capping-head space 60, which is shown in FIG. 6, can accordingly be formed around the mouth 102 of the container 100 by corresponding closure of the capping-head jaws 64, 66. The capper 62 is in this case arranged above the mouth 102 of the container 100 in order accordingly to allow the container 100 to be capped.

In the opened position, shown in FIG. 6, of the capping-head jaws 64, 66 of the capping head 6, a container 100 can be introduced or discharged.

The filling method accordingly occurs in such a way that, as is shown schematically for example in FIG. 7, the capping head 6 is closed and holds the container 100 in a sealed manner such that the mouth 102 of the container 100 is located in the capping-head space 60. As a result of the filling-product line 3 being advanced such that the centering bell 30 is pressed in a sealing manner with its seal 300 on the mouth 102 of the container 100, a direct connection of the filling-product line 3 and thus of the interior of the container 100 to a filling-product reservoir 2, to a vacuum device 4 and to a pressurizing-gas device 5 can accordingly be formed.

The actual filling operation then accordingly proceeds in the manner already described with respect to FIGS. 2 and 3. In particular, purging of the container 100 with $CO_2$ is first of all carried out, to which end first of all evacuation takes place via the vacuum device 4 and then the container 100 is flooded with $CO_2$. Subsequently, pumping out takes place again via the vacuum device 4 and then the filling product is introduced into the vacuum produced in this way or the negative pressure in the container 100 in that the filling-product valve 32 is opened. Accordingly, abrupt filling of the container 100 with the filling product 110 takes place.

Once the filling-product valve 32 has been closed again after the end of filling has been reached, a pressurizing gas is applied via the pressurizing-gas device 5 such that foam possibly located in the foam space is pushed completely into the container 100 and accordingly a positive pressure is built up in the headspace of the container 100.

When the desired positive pressure in the container 100 has been achieved, the sealing of the centering bell 30 with the interior of the container 100 is removed, for example by lifting off the centering bell 30. Then, the filling-product line 3 is retracted such that the centering bell 30 is retracted into the parked positioned shown for example in FIG. 4.

Figure 4:
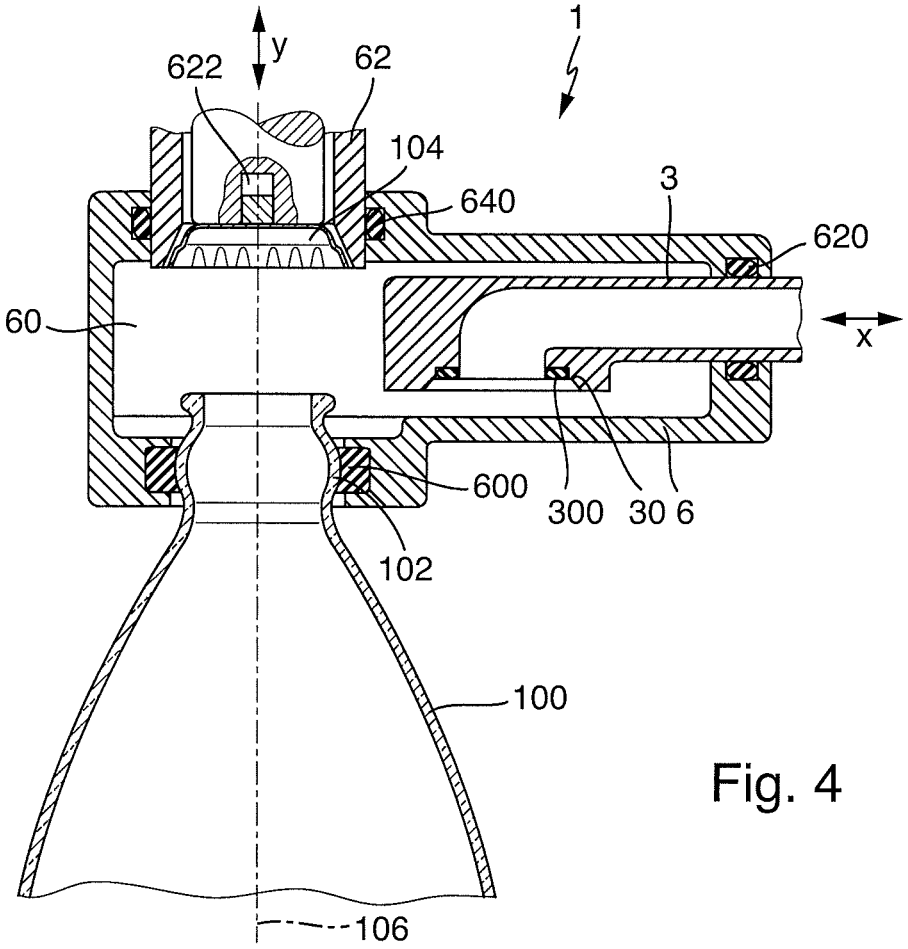
FIG. 4 shows a schematic sectional illustration, viewed from the side, of a capping head of a device for filling a container.

The capping-head space 60 is now likewise subjected to the pressurizing gas, since when the filling-product line 3 is retracted, the filling-product line 3 then becomes fluidically connected to the capping-head space 60. Accordingly, in the retracted position of the centering bell 30, as is shown in FIG. 4, the capping-head space 60, too, can be subjected to the pressurizing gas, for example $CO_2$, via the filling-product line 3. In a variant, the capping-head space 60 can be subjected to pressurizing gas even before the container 100 is filled, wherein this can be achieved via a centering bell 30 that has not yet been applied in a sealing manner to the container 100.

Accordingly, when the centering bell 300 is detached, the pressure present in the container 100 is not relieved, but rather the pressure applied by the pressurizing-gas device 5 continues to be maintained and applied to the interior of the container 100. This is achieved in particular in that the interior of the container 100 communicates with the capping-head space 60. Thus, it is accordingly possible to avoid $CO_2$ being liberated or filling product shooting out of the mouth 102 of the container 100, and for the same state to be maintained which is achieved after the abrupt filling of the container 100 and the subsequent subjecting of the headspace of the container 100 to the pressurizing gas. In other words, it is possible to avoid the filling product running over or foaming over or shooting out, since the pressure level in the container 100 is not changed even when the connection of the filling-product line 3 is detached from the mouth 102.

Once the filling-product line 3 has then been retracted and the centering bell 30 accordingly arranged in the parked position shown in FIG. 4, the capper 62 can be lowered and can apply the container cap 104, for example the crown cap, to the container 100. Accordingly, the container 100 is capped under the pressure which is present in the capping-head space 60 that is to say under a positive pressure.

As soon as the container cap 104 has been applied to the container 100, the pressure in the capping-head space 60 can be released. This is achieved in the exemplary embodiment shown in that the capping-head jaws 64, 66 are opened. Then, the fully filled and capped container 100 can be discharged.

The capping-head jaws 64, 66 are, as already described above, provided with a multiplicity of seals which make it possible to provide both secure sealing of the mouth region 102 of the container 100 and also secure sealing with respect to the movable filling-product line 3 or with respect to the capper 62 when the capping-head jaws 64, 66 are arranged in the closed position, as shown for example in FIG. 5. The respective components are accordingly received in the capping-head jaws 64, 66 via corresponding recesses.

The filling-product line 3 together with the centering bell 30 and the capper 62 remain roughly in the same position when the capping-head jaws 64, 66 are opened and closed. In the opened position of the capping-head jaws 64, 66 it is not only possible for the container 100 to be filled to be received, but also for a new container cap 104 to also be transferred to the capper 62.

As a result of the arrangement of the capper 62 and of the filling-product line 3 together with the centering bell 30 in the closed-off capping-head space 60, it is accordingly possible for the container 100 to be able to be capped once the container 100 has been filled, without the container 100 being relieved of pressure or without the pressure conditions changing between filling and capping.

A positive pressure is generally present in the capping-head space 60. This positive pressure can be at an absolute pressure of about 2 bar to 9 bar, for example at a positive pressure with an absolute pressure of about 2.5 bar to 6 bar, or at a positive pressure which corresponds to the saturation pressure of the filling product 110, for example at an absolute pressure of about 1.1 bar to 6 bar, or at a positive pressure which is above the saturation pressure of the filling product 110, for example at an absolute pressure of about 1.6 bar to 9 bar. As a result of the abovementioned positive pressures, in particular when $CO_2$ is used as pressurizing gas, it is possible to prevent the $CO_2$ from being liberated from the carbonated, abruptly bottled filling product 110, and so accordingly the filling product 110 can be prevented from foaming over, running out or shooting out of the mouth 102 of the container 100 after the centering bell 30 is removed.

By way of the described arrangement, a combined system of capper and filler is provided, wherein the number of filling members corresponds substantially to the number of capping members. In some embodiments, the number of filling stations corresponds to 1 to 2 times the number of capping stations. In one embodiment, filling members and capping members can also be provided in different carousels, wherein, however, the number of filling members and of capping members is substantially the same.

The different method steps, for example the opening and closing of valves, the advancing or retracting or pivoting of the centering bell 30, the raising and lowering of the capper 62 or the opening and closing of the capping-head jaws 64, 66 are controlled as a whole, or at least to a significant extent, via the control device 7. The control device is designed and configured such that the method steps proceed as described.

Figure 8:
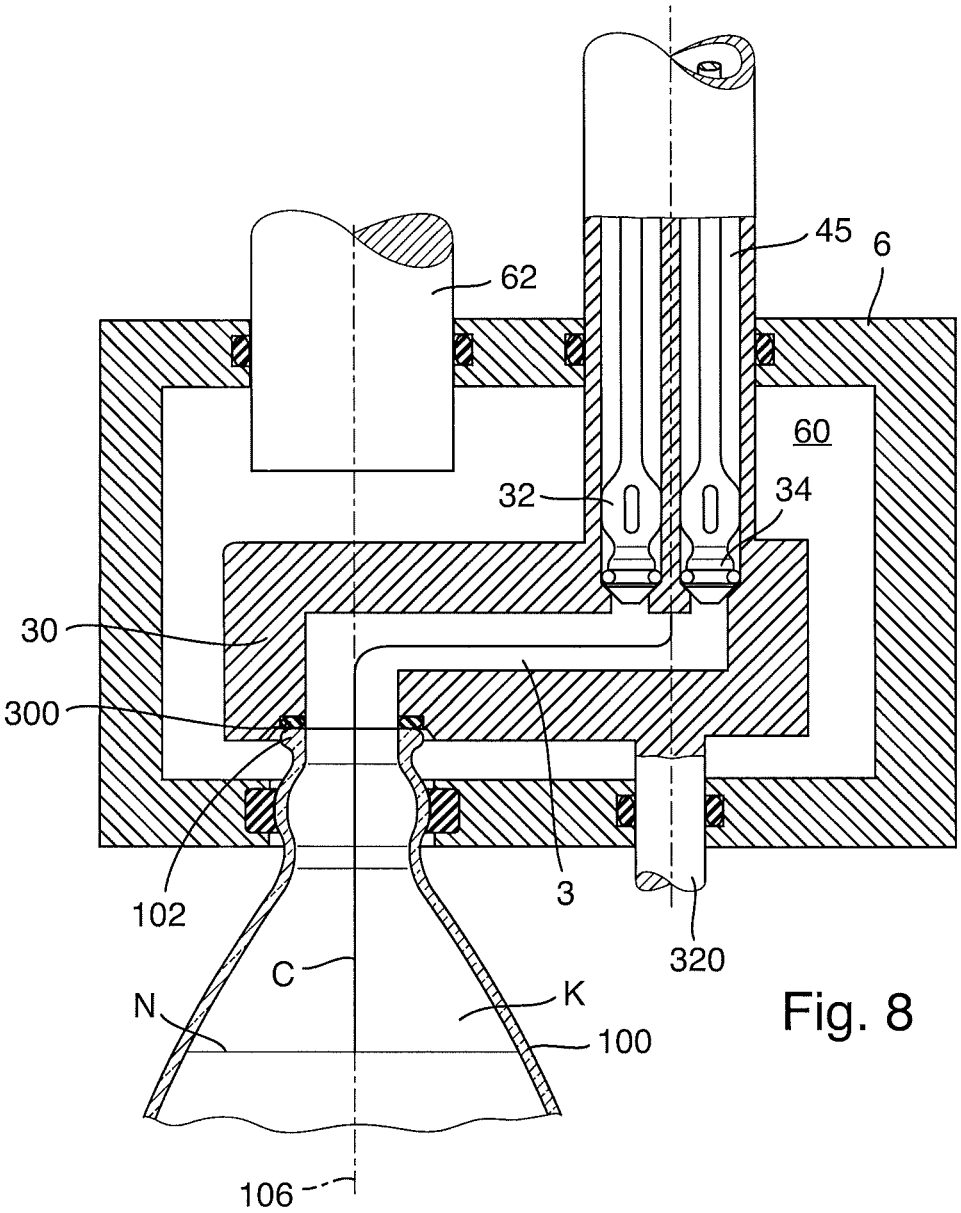
FIG. 8 shows a schematic sectional illustration of a capping head in one embodiment.

FIG. 8 shows a variant of a capping head 6 in which the filling-product line 3 is not, as shown in FIGS. 4 to 7, displaceable along its length but is pivotable about a rotation axis 320. Accordingly, the filler bell 30, having its respective seal 300 with the mouth 102 of the container 100, can be filled by the centering bell 30 being correspondingly positioned over the mouth 102 and after completion of the filling operation, the filling-product line 3 can be pivoted into a parked position about the pivot axis 320 in the capping-head space 60, whereupon the capper 62 can cap the container 100.

In the exemplary embodiment shown, there continues to be a filling-product valve 32, which is configured as a bevel-seated valve, and a shut-off valve 34, likewise configured as a bevel-seated valve, which shuts off the combined gas line 45 which allows either the provision of a vacuum or the provision of a pressurizing gas via the filling-product duct 3. The lines and valves extend along the rotation axis 320 in order to achieve a connection of the fluid-conducting lines that is as simple as possible.

Once the filling-product line 3 has been pivoted into its parked position in the exemplary embodiment shown in FIG. 8, it is again possible for the capping-head space 60 to be subjected to the pressurizing gas via the filling-product line 3. Here too, the capping-head space 60 can already be subjected to the pressurizing gas before the filling operation starts.

It is possible for the foam space C to have only a small volume as a result of the arrangement of the filling-product valve 32 and of the shut-off valve 34 very close to the centering bell 30, this volume allowing precise filling of the container 100 and also allowing complete clearing of the filling-product duct 3 with the pressurizing gas, and thus droplet-free filling.

Figure 9:
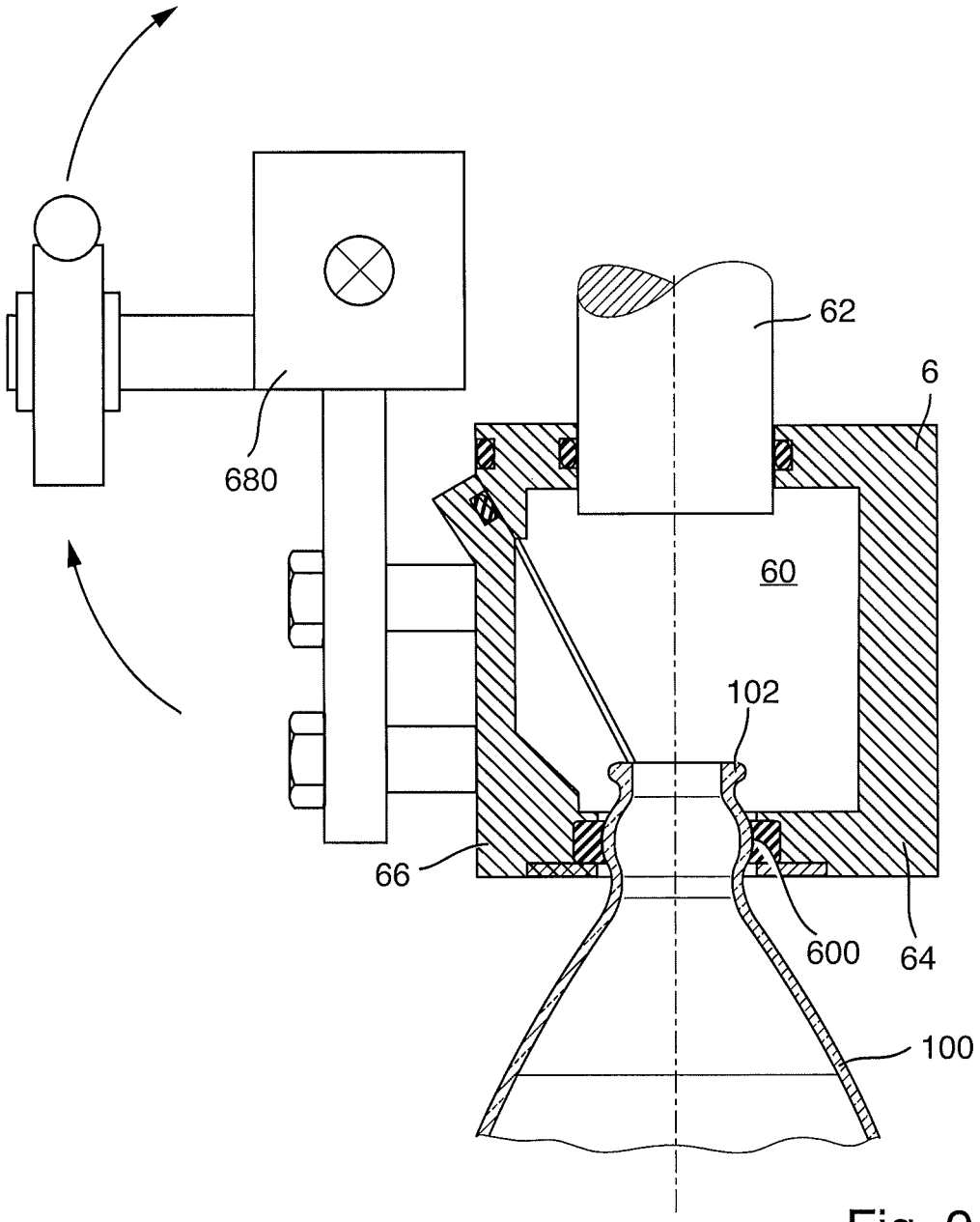
FIG. 9 shows a schematic sectional illustration of a capping head in another embodiment.

FIG. 9 shows a further embodiment of a capping head 6, wherein in this case the filling-product line is not shown. Provision is made of two capping-head jaws 64, 66 which can be pivoted with respect to one another and which allow quick and easy opening of the capping-head space 60 in order to receive the container 100. To this end, the front capping-head jaw 66 is pivoted upwards in the direction of the arrow, wherein in this case the front capping-head jaw 66 can be pivoted laterally outwards via a vertical toggle clamp 680, in order to receive a container 100 or to discharge a fully filled container 100. The opening also serves to transfer a container cap 104 to the capper 62.

In the exemplary embodiment shown in FIG. 9, only the container 100 or the mouth 102 of the container 100 is received by the pivoting of the capping-head jaws 64, 66. The remaining components, for example the capper 62 and the filling-product inlet (not shown) are, however, not enclosed jointly by the capping-head jaws 64, 66 but are received in the stationary capping-head jaw 64. As a result, the capping behaviour and sealing behavior of the respective seals can be improved.

In an exemplary embodiment that is not shown, a separate chamber is provided for each container 100, said chamber, independently of the capping-head space 60, receiving the container 100 in a space that is sealed off from the environment, but in this case leaving at least the mouth 102 of the container 100 free such that said mouth can dip into the capping-head space 60.

In the separate chamber, in which the container 100 is received, it is likewise possible to apply a negative pressure which can correspond to the negative pressure generated in the container 100. In this way, the same pressure conditions can be created on the inside and on the outside of the container 100 to be filled, such that it is also possible to evacuate containers 100 having soft or flexible walls and accordingly the filling product can be filled into the container subjected to a negative pressure.

Figure 10:
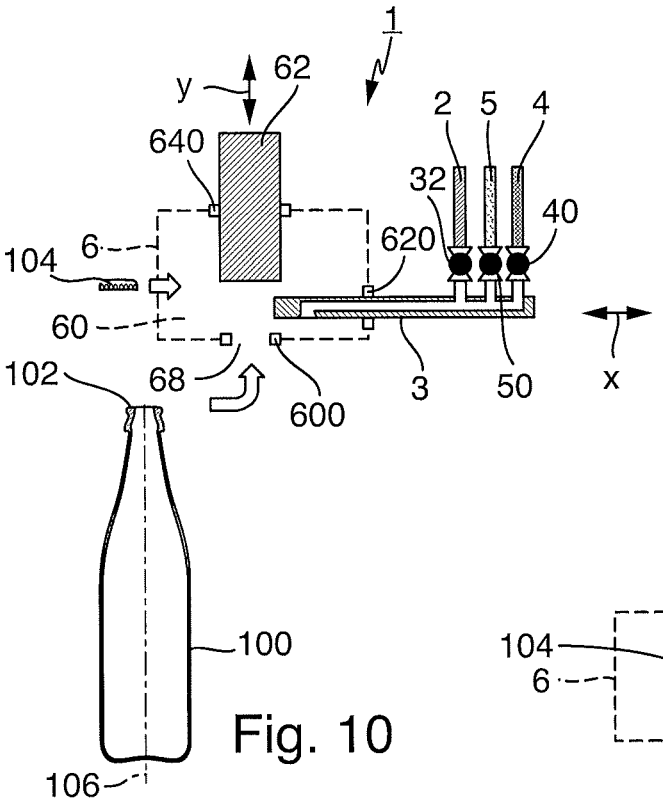
FIG. 10 shows a schematic sectional illustration of another device for filling a container with a filling product, having an opened capping head for supplying a container to be filled and a cap.

FIG. 10 schematically shows a device 1 for filling a container 100 with a filling product, wherein the container 100 has a mouth 102 through which the filling product is intended to be introduced into the interior of the container 100.

The device 1 includes a filling-product line 3 which has a centering bell 30 which is provided to receive the mouth 102 of the container 100. The filling-product line 3 is displaceable in a displacement direction X in order to be positionable over the mouth 102 of the container 100 and, in the retracted position shown in FIG. 10, to give a capper 62 the possibility to apply a container cap 104.

In FIG. 10, the capper 62 is likewise shown in a retracted position in which a container cap 104, which is in this case shown in the form of a crown cap, can be supplied to the capper 62. The capper 62 is raisable and lowerable in the stroke direction Y of the capper in order to accordingly be movable back and forth between the retracted position shown in FIG. 10 and a capping position.

The filling-product line 3 and the capper 62 extend into a schematically illustrated capping head 6 which encloses a capping-head space 60. The feedthrough of the filling-product line 3 is sealed off in a pressure-tight manner via a filling-product-line seal 620, a pressure-tight feedthrough of the capper 62 is achieved by a capper seal 640 and pressure-tight reception of the mouth 102 of the container 100 is achieved by a container seal 600. In the exemplary embodiment shown in FIG. 10, the capping head 6 is opened such that not only can the container cap 104 be supplied to the capper 62 but also a container 100 can be introduced by way of its mouth 102. The mouth 102 is in this case received by the container seal 600 such that the interior of the container 100 is sealed off throughout by the capping-head space 60 and accordingly forms a common volume which is sealed off from the environment.

Accordingly, FIG. 10 shows a state of the device 1 in which the capping head 6 is opened, for example by capping-head jaws (not explicitly shown here) being opened such that the capper 62 can be supplied with the container cap 104 and the container 100 to be filled can likewise be received in a sealing manner by way of its mouth 102. In this state, in one embodiment, both the capper 62 and the filling-product line 3 are arranged in a retracted position, for example in a parked position, in which they do not mutually hinder one another and also do not block the receiving of the container 100 to be filled.

The capper 62 naturally moves in the stroke direction Y of the capper 62 along the container axis 106 in order to allow the container cap 104 to be applied to the mouth 102 of the container 100 in a known way. The capper 62 can in this case, as shown in FIGS. 10-21, be a capper by means of which a crown cap is applied. In an alternative configuration, the capper 62 can also apply roll-on caps, screw caps or stoppers, however. In the exemplary embodiments shown, the capper 62 should be understood here as being merely schematic and is not limited to the crown-cap capper shown. Rather, any possible type of closure can be applied by means of a corresponding capper 62.

In order to allow the corresponding application of the container cap 104 to the container 100 or to the mouth 102 thereof, the container receptacle 68 of the capping head 6 is configured such that, together with the container seal 600, it holds the container 100 such that problem-free capping of the container 102 by way of the capper 62 is possible. Firstly, the container receptacle 68, which is indicated only schematically here, is configured such that the mouth 102 is arranged in a substantially centered manner with respect to the capper 62, such that as a result of the capper 62 being lowered in the stroke direction Y, the container cap 104 can be applied directly to the mouth 102. Furthermore, the container receptacle 68 is configured such that a closing force exerted by the capper 62 can be dissipated to the capping head 6 without the container 100 being substantially displaced in the container receptacle 68. In the case of the capper 62 configured as a crown-cap capper, the container 100 is accordingly held in the container receptacle 68 such that a force exerted by the capper 62 on the mouth 102 of the container 100 in the direction of the stroke direction Y can be absorbed.

If the capper 62 is configured as a screw capper for applying screw caps or as a roll-on capper for applying roll-on caps, the container receptacle 68 is accordingly configured such that it can also dissipate the torque introduced via the screw capper such that the container 100 does not rotate or rotates only insignificantly in the container receptacle 68.

Furthermore, the container receptacle 68 is configured such that the mouth 102 of the container 100 protrudes to such an extent into the capping-head space 60 that problem-free capping is allowed without the capper 62 or the container cap 104 butting against structures or internal surfaces of the capping head 6 defining the capping-head space 60.

As already described above, the filling-product line 3 is connected to a filling-product supply in the form of a filling-product reservoir 2 via a filling-product valve 32, to a vacuum device 4 via a vacuum valve 40, and to a pressurizing-gas device 5 via a pressurizing-gas valve 50.

A method for filling a container 100 with a filling product, in particular with a carbonated filling product such as beer, carbonated soft drinks, mineral water, sparkling wines etc., will now be described in the following text.

In FIG. 10, the container 100 is supplied to the container receptacle 68 and the container cap 104 is supplied to the capper 62. Subsequently, the capping head 6 is closed such that the capping-head space 60 is closed off from the environment in a gastight and pressure-tight manner.

Figure 11:
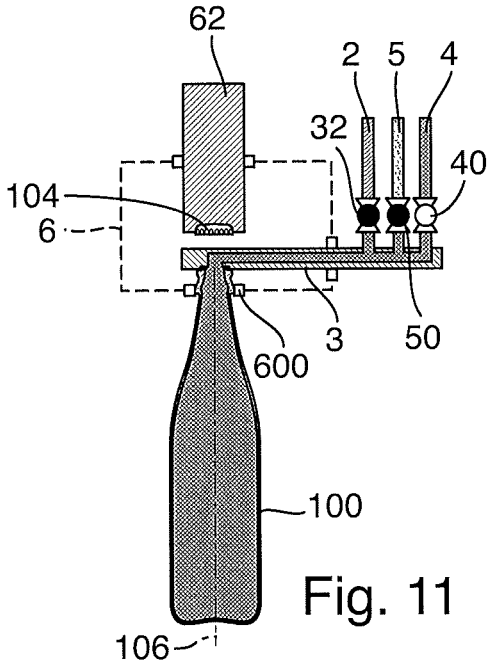
FIG. 11 shows a schematic sectional illustration of the device from FIG. 10 with a closed capping head and a filling-product line connected to the interior of the container during the initial evacuation of the container to be filled.

FIG. 11 shows a further step, in which the container 100 is connected to the filling-product line 3, the vacuum valve 40 is opened and accordingly the vacuum device 4 is in communication with the interior of the container 100 via the filling-product line 3 and accordingly the interior of the container 100 is evacuated. In this way, the ambient air still present in the container 100 is drawn out of the interior of the container 100.

Figure 12:
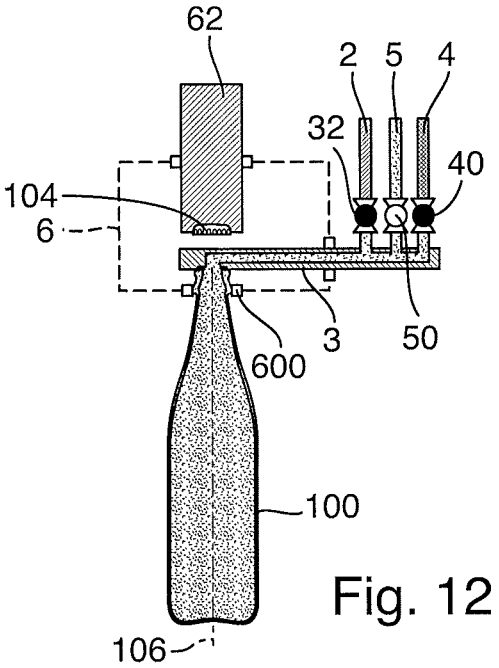
FIG. 12 shows a schematic sectional illustration of the device from FIGS. 10 and 11 during the purging of the container to be filled with a pressurizing gas.

In FIG. 12, the vacuum valve 40 is closed and instead the pressurizing-gas valve 50 is opened, in order to accordingly let an inert gas, such as $CO_2$, into the interior of the container 100 via the pressurizing-gas device 5. As a result, the ambient air still located in the container volume of the container 100 following the evacuation in the step shown in FIG. 11 is diluted by the inert gas.

Figure 13:
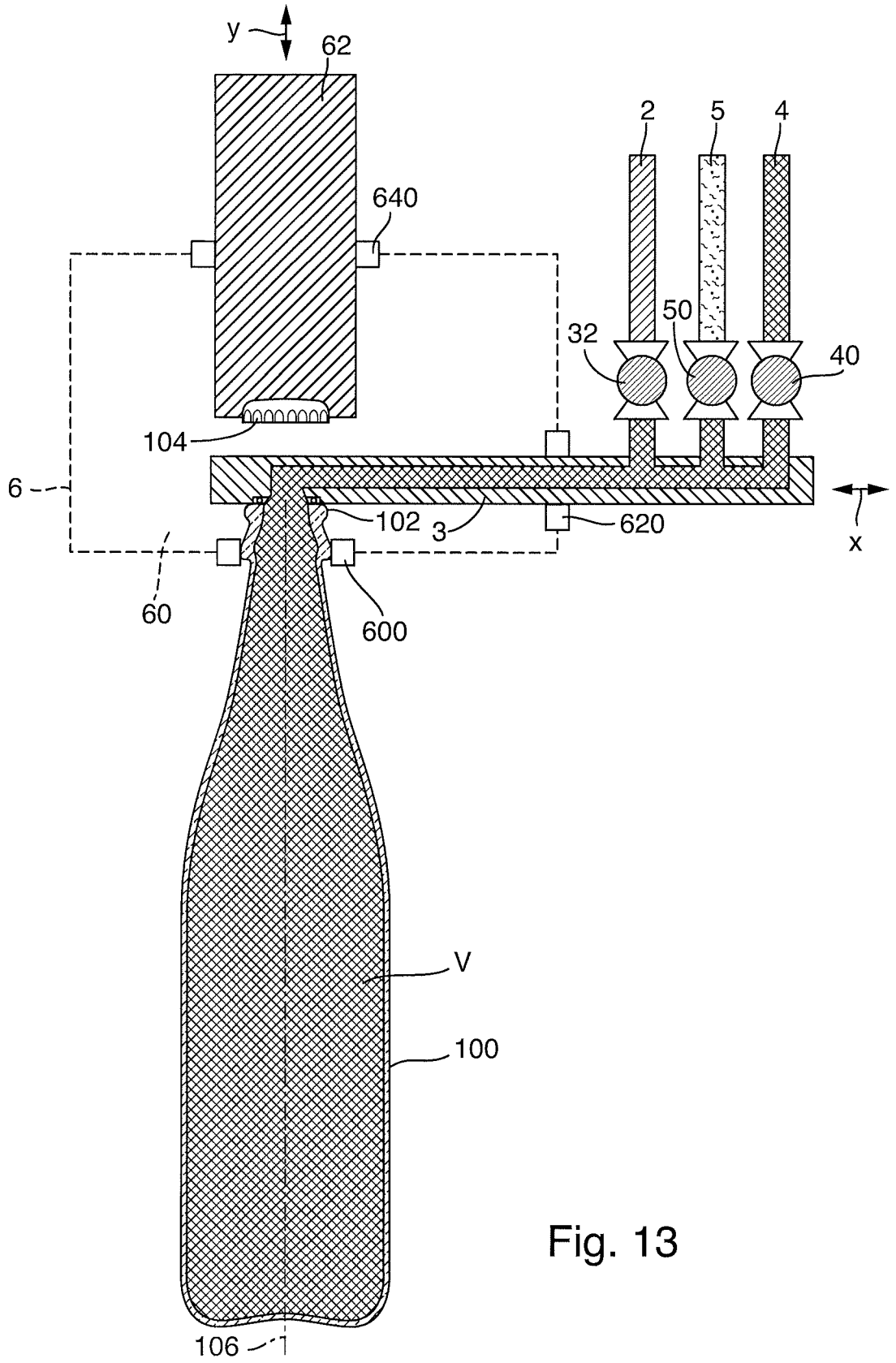
FIG. 13 shows a schematic sectional illustration of the device from FIGS. 10-12 during the provision of a negative pressure in the container to be filled.

In the next step, which is shown in FIG. 13, the vacuum valve 40 is opened again in order to set the interior of the container 100 into communication with the vacuum device 4 via the filling-product line 3. In this way, the residual air remaining in the container volume of the container 100 is drawn out again together with the inert gas, for example the $CO_2$, such that a negative pressure is produced in the container 100 to be filled, wherein in this case an absolute pressure of about 0.5 bar to 0.05 bar, in one embodiment of about 0.3 bar to 0.1 bar, and in another embodiment of about 0.1 bar is achieved. In this way, the residual oxygen content in the container volume V can be reduced even further in order accordingly to achieve a for example 99% reduction in the atmospheric oxygen, compared with the initial state, in the container under negative pressure. Such a low-oxygen state in the container volume V of the container 100 to be filled is important in particular when oxygen-sensitive filling products are intended to be bottled, for example in the bottling of beer or fruit juices.

Once the negative pressure has been achieved in the container 100 in the step shown in FIG. 13, the filling-product valve 32 is then opened such that the filling-product supply 2 is in communication with the filling-product line 3 and the container 100. The filling-product supply 2 includes the filling product 110 under a positive pressure compared with the negative pressure in the container 100. The positive pressure in the filling-product supply 2 may be at an absolute pressure of about 1 bar to 9 bar, in one embodiment at an absolute pressure of about 2.5 bar to 6 bar, and another embodiment at an absolute pressure of about 2.8 bar to 3.3 bar.

Figure 14:
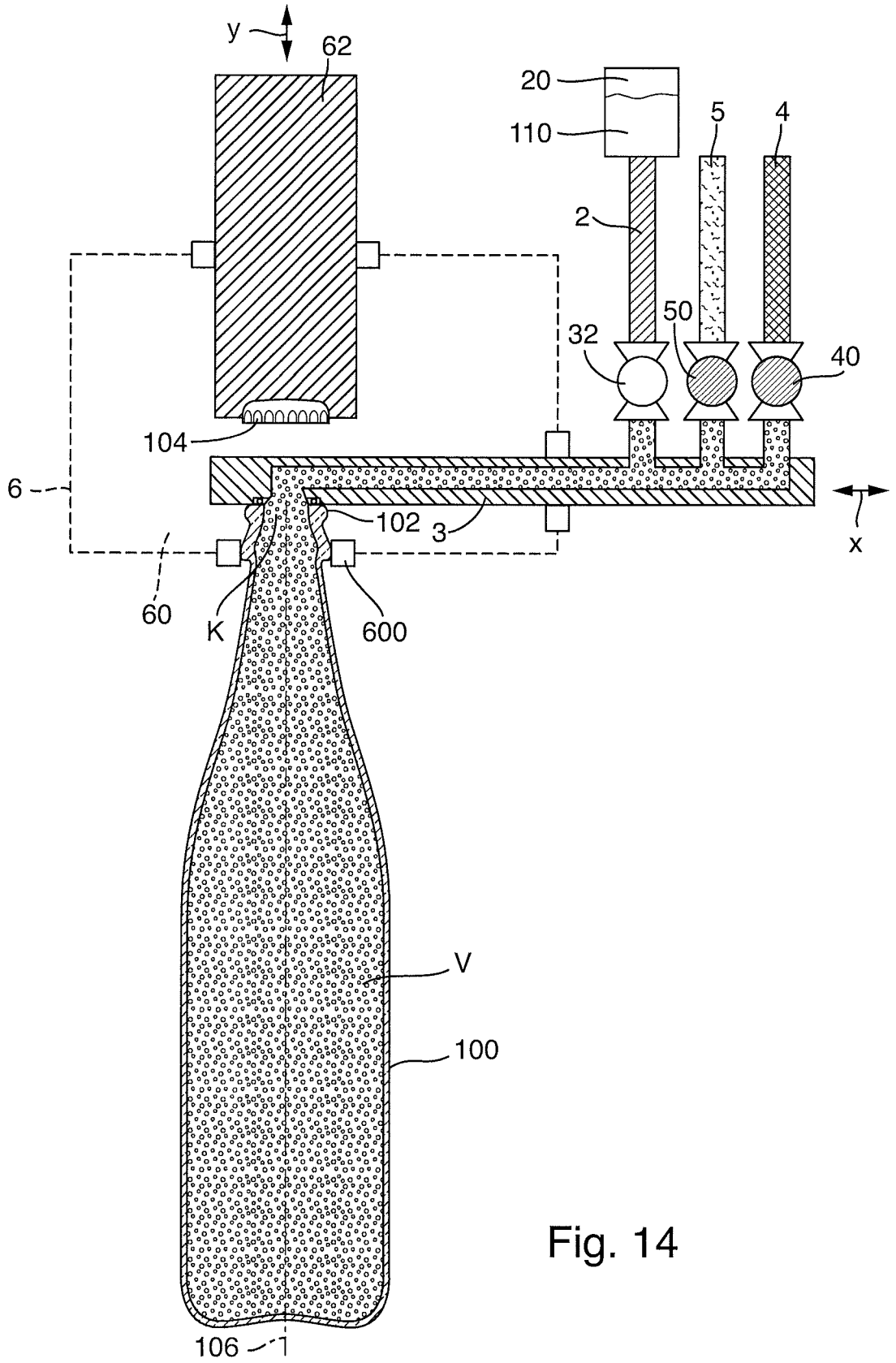
FIG. 14 shows a schematic sectional illustration of the device from FIGS. 10-13 during the filling of the container to be filled with a filling product under positive pressure into the container to be filled, which is under negative pressure.

If, in the method step in FIG. 14, the filling-product valve 32 is then opened, the filling product 110 shoots abruptly through the filling-product line 3 into the volume V of the container 100. The container 100 is filled accordingly abruptly and accordingly very quickly with the filling product. When the end of filling is reached, the filling-product valve 32 is accordingly closed again.

Since the container 100 was not evacuated to an absolute vacuum but is at an absolute pressure of, in one embodiment, about 0.5 bar to 0.05 bar, as a result of the filling with the filling product, the negative pressure in the container 100 is gradually reduced. Since, however, a positive pressure, in one embodiment, of about 1 bar to 9 bar is present in the filling-product supply 2, the pressure gradient between the container 100 and the filling-product supply 2 is ensured even towards the end of the filling operation.

The end of filling and accordingly the closing of the filling-product valve 32 can be determined by various methods. For example, volumetric filling can be accomplished using a flowmeter, or temporal filling, in which the filling-product valve 32 is closed again after a particular opening time.

In an alternative, in order to determine the end of filling, the rise in pressure in the container 100 is determined, and when a particular pressure in the container 100 is exceeded, the filling-product valve 32 is closed.

Once the filling-product valve 32 is closed, the container 100 has been filled with the filling product. However, a carbonated filling product will also display a very high foaming tendency on account of the $CO_2$ liberated on account of being filled into the container under negative pressure, such that foam is present in the filling-product line 3 and in the headspace K of the container 100.

Figure 15:
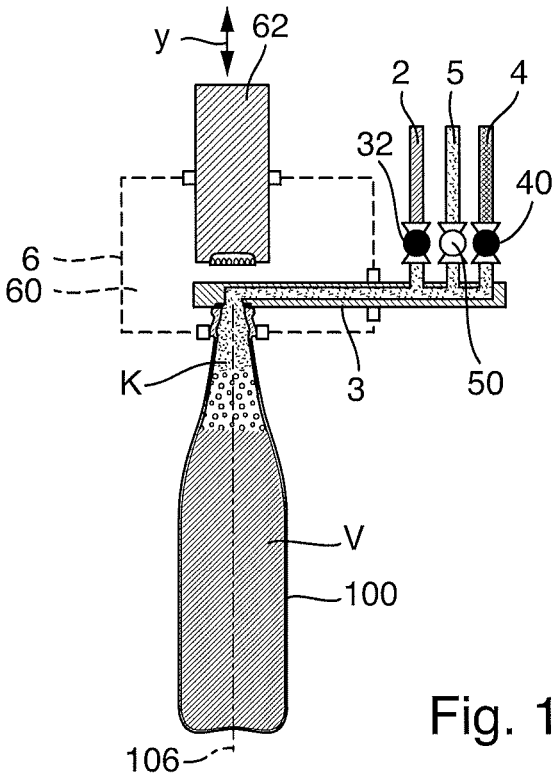
FIG. 15 shows a schematic sectional illustration of FIGS. 10-14 once the container to be filled has been filled with a filling product and subjected to a pressurizing gas.

In FIG. 15, the pressurizing-gas valve 50 is accordingly opened in order to bring the container 100 into communication with the pressurizing-gas device 5. The pressurizing gas can be fed in at an absolute pressure of about 2 bar to 9 bar, in one embodiment at an absolute pressure of about 3.5 bar to 7 bar, and in a further embodiment at an absolute pressure of about 3.8 bar to 5.5 bar, wherein the pressure of the pressurizing gas which is provided via the pressurizing-gas device 5 can be identical to the pressure in the filling-product supply 2.

As a result of the filling-product line and the container 100 and in particular the headspace K of the container 100 being subjected to the pressurizing gas, the foam which is still located in the filling-product line 3 is pushed into the container 100 in order in this way to achieve substantial emptying of the filling-product line 3. Furthermore, the headspace K of the container 100 is subjected to the pressurizing gas, with the result that the foam present here, too, is pushed back. Furthermore, on account of the high pressurizing-gas pressure, renewed dissolving of the $CO_2$ in the filling product which is located in the container 100 is supported and so the filling product settles more quickly.

In the state shown in FIG. 14, partial liberation of the $CO_2$ has occurred as a result of the filling product being filled into the container 100 to be filled that is under negative pressure. Accordingly, a large number of microbubbles of liberated $CO_2$ are present in the filling product which has been filled into the container 100. As a result of being subjected to the pressurizing gas that is under pressure, quicker settling of the filling product can accordingly be achieved.

Figure 16:
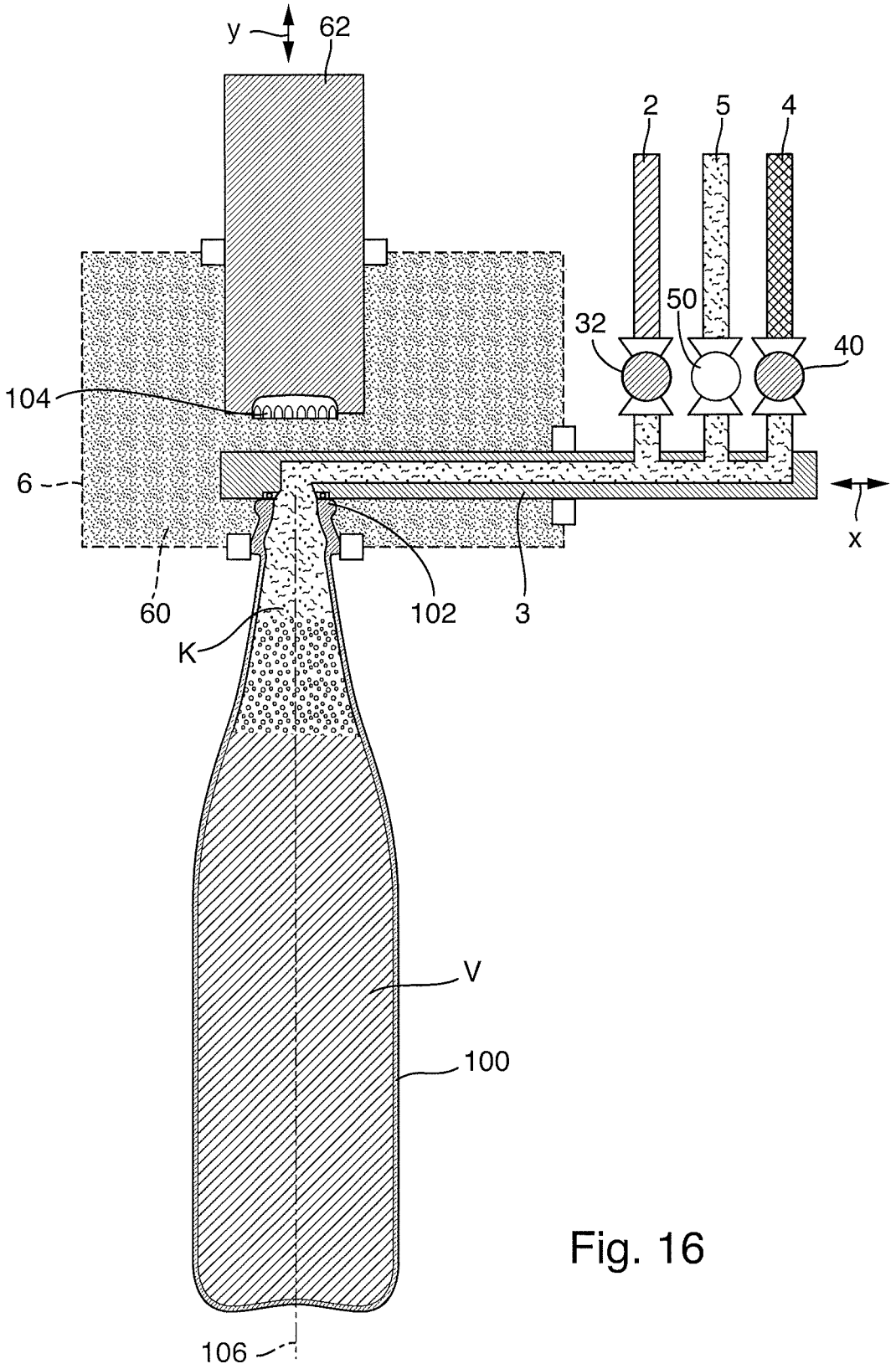
FIG. 16 shows the device according to FIGS. 10-15 while the capping-head space is being subjected to the pressurizing gas.

Since, in the step shown in FIG. 15, both the filling-product line 3 and the headspace K of the container 100 have been subjected to the pressurizing gas with the pressurizing-gas valve 50 opened, the filling-product line 3, as shown in FIG. 16, is lifted slightly off the mouth 102 of the container 100, such that the capping-head space 60 is also subjected to the pressurizing gas. Accordingly, when the pressure equilibrium is set, the same gas is present under the same pressure both in the headspace K and in the capping-head space 60. Thus, the capping-head space 60 is also at a pressure with the inert gas, for example $CO_2$, which is can be at an absolute pressure of about 2 bar to 9 bar, in certain embodiments at an absolute pressure of about 3.5 bar to 7 bar, in some embodiments at an absolute pressure of about 3.8 bar to 5.5 bar, and in various embodiments at the same pressure as the pressure which also prevails in the filling-product supply 2.

Figure 17:
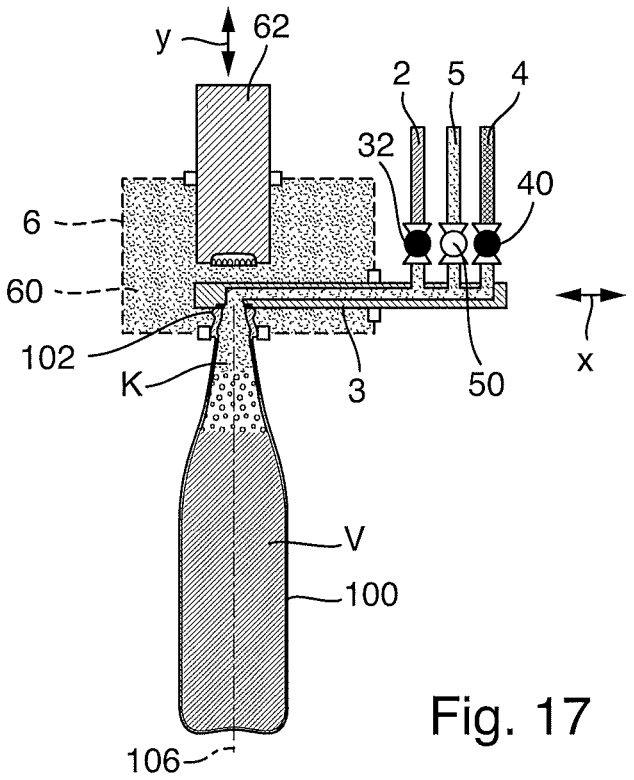
FIG. 17 shows a schematic sectional illustration of the device from FIGS. 10-16 during the detachment of the connection of the filling-product line from the filled container.

FIG. 17 shows the next step, in which the filling-product line 3 has been lifted completely off the mouth 102 of the container 100 and the pressurizing-gas valve 50 has been opened further. Accordingly, the pressure both in the headspace K of the container 100 and in the capping-head space 60 of the capping head 6 is maintained via the filling-product line 3. In this way, the filling-product line 3 can be lifted off the mouth 102 of the container 100 without the filling product shooting out of the mouth 102 or the filling product foaming over, since the pressure applied in the capping-head space 60 both keeps the foam in the headspace K of the container 100 pushed back and also furthermore supports renewed dissolving of the $CO_2$ in the container 100.

Accordingly, on account of the capping-head space 60 being subjected to the pressurizing gas under an increased pressure, it is possible that even in the event of the preceding abrupt filling of the container 100 even with carbonated filling products, for example even with beer, foaming over even after a short dwell time of the filling product and a not yet settled or not yet completely settled filling product in which a part of the $CO_2$ volume has not yet gone back into solution, lifting of the filling-product line 3 can be achieved without the filling product emerging from the mouth 102.

Figure 18:
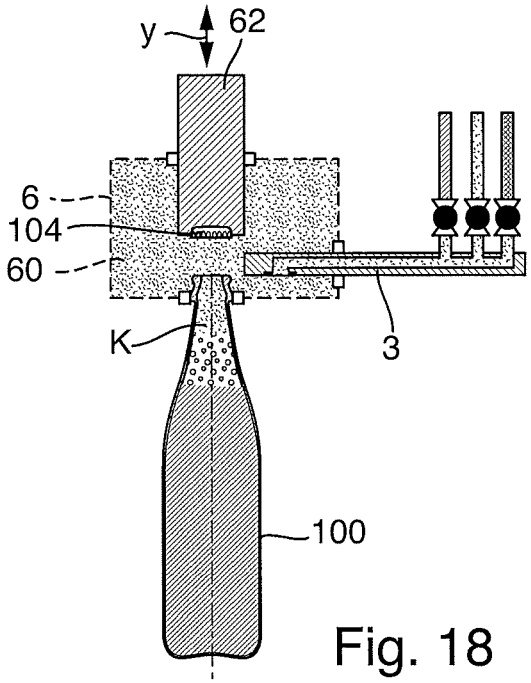
FIG. 18 shows a schematic sectional illustration of the device from FIGS. 10-17 during the retraction of the filling-product line.

FIG. 18 schematically shows that the filling-product line 3 has been retracted in the displacement direction X and has accordingly been brought into the parked position. The pressure of the pressurizing gas in the capping-head space 60 continues to be maintained via the opened pressurizing-gas valve 50.

Figure 19:
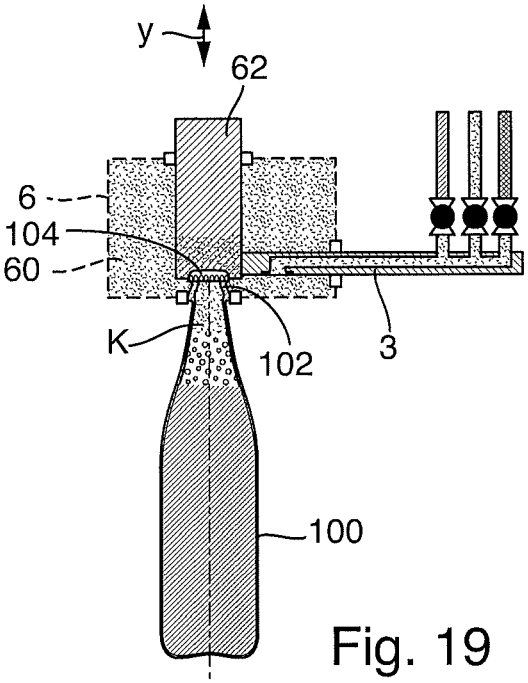
FIG. 19 shows a schematic sectional illustration of the device from FIGS. 10-18 during the capping of the filled container.

Accordingly, as schematically shown in FIG. 19, the capper 2 can then be lowered in the stroke direction Y such that the container cap 104 can be applied to the mouth 102 of the container 100. The capping-head space 60 continues to be under pressure, since the pressurizing gas is still present in the capping-head space 60. The headspace K of the filled container 100 likewise continues to be under pressure, specifically under the same pressure as the pressure which also prevails in the capping-head space 60. Accordingly, capping of the container 100 can be carried out by applying the container cap 102 by way of the capper 62 under a positive pressure without filling product emerging.

Figure 20:
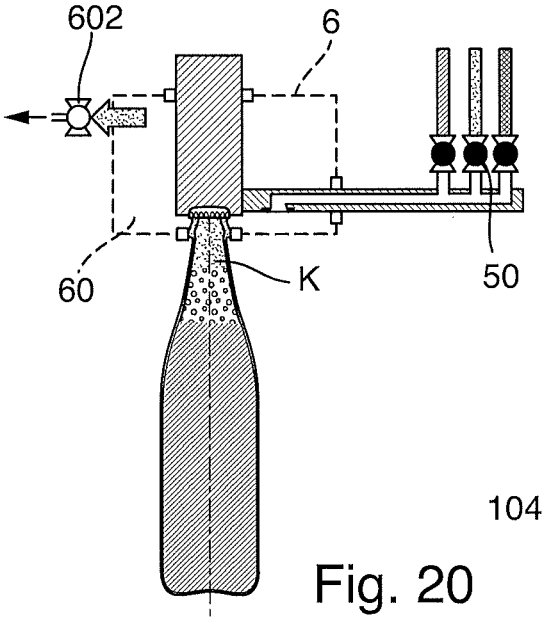
FIG. 20 shows a schematic sectional illustration of the device from FIGS. 10-19 during the depressurization of the capping-head space.

Following completion of the capping operation, as shown in FIG. 20, the capping-head space 60 is vented via a venting valve 602 such that the positive pressure in the capping-head space 60 is relieved to ambient pressure.

Figure 21:
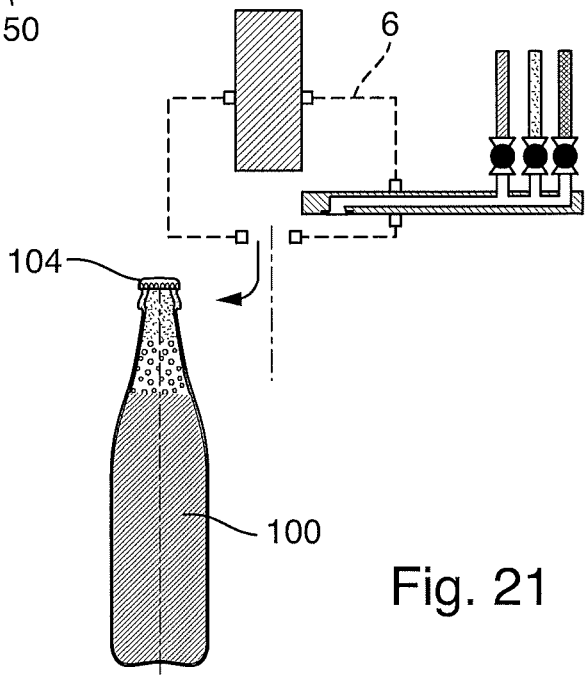
FIG. 21 shows a schematic sectional illustration of the device from FIGS. 10-20 with the capping head opened in order to discharge the filled and capped container.

Subsequently, the capping head can be opened, as shown in FIG. 21, and the now filled container which is capped by way of the container cap 104 can be discharged. Subsequently, the next container 100 to be filled, as shown from FIG. 10, can be filled using the same method again.

Prior to the venting of the capping-head space 60 in FIG. 20, the pressurizing-gas valve 50 is closed again.

Figure 22:
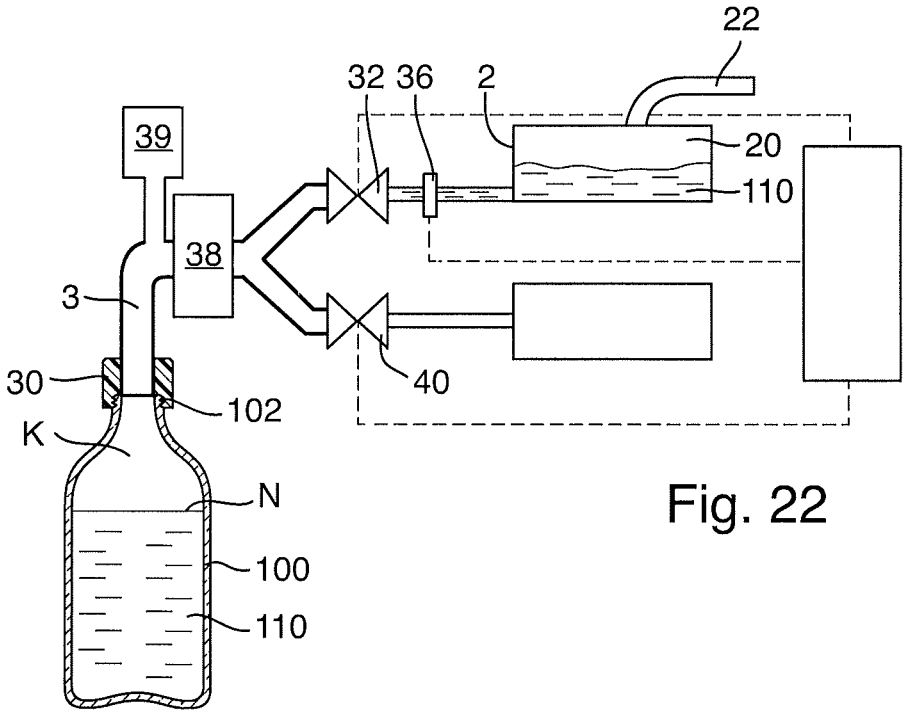
FIG. 22 shows the schematic illustration of a device for filling a container with a filling product according to FIG. 1, in a development with a flavoring metering means.

FIG. 22 shows a further embodiment based on the device 1 already described with respect to FIG. 1. In addition to the features provided in FIG. 1, provision is made of a flavoring metering means 39 by means of which flavorings and/or beverage additives and/or beverage ingredients can be metered into the interior of the container 100. Beverage additives are understood here as including syrup and/or preservatives.

In the exemplary embodiment shown, the flavoring metering means 39 leads into the filling-product line 3 such that the supplied flavoring and/or the beverage additive and/or the beverage ingredient passes into the interior of the container 100 along the same path as the filling product supplied via the filling-product line 3.

In the exemplary embodiment shown, the flavoring metering means 39 leads into the filling-product line 3 downstream of the filling-product valve 32, such that flavorings and/or beverage additives and/or beverage ingredients can be metered in even with the filling-product valve 32 closed. Metering in can therefore be carried out prior to the introduction of the filling product from the filling-product supply 2, during the filling of the filling product or following the conclusion of the filling operation. Metering in following the conclusion of the filling operation and after the filling product in the container 100 has settled is generally desired in this case.

The flavoring metering means 39 can in this case be configured for example in the form of a peristaltic pump by means of which precise metering of the respective flavoring or of the respective beverage additive from a corresponding reservoir is possible.

Provision can also be made of a number of flavoring metering means 39, or optionally different flavorings and/or beverage additives and/or beverage ingredients can be supplied by means of one flavoring metering means 39, such that the flavoring metering means 39 is or are designed and can be actuated such that, for each individual filling operation, a different flavoring concentration, beverage-additive concentration or combination of flavorings and/or beverage additives and/or beverage ingredients can be selected. During normal filling operation, however, for reasons of the operational procedure, batches of a first flavor are usually bottled first, before the flavor is changed. The same goes for a change between beverage types, such as between beverages with fruit fibers and beverages without fruit fibers, for example.

Figure 23:
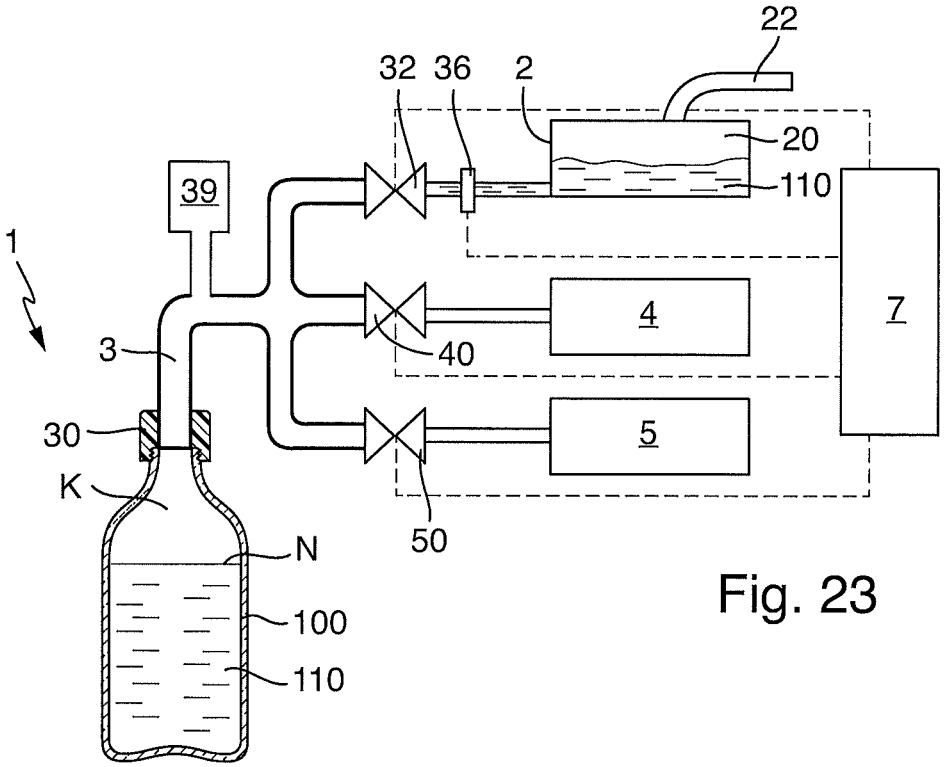
FIG. 23 shows the schematic illustration of a device for filling a container with a filling product according to FIG. 2, in a development with a flavoring metering means.

FIG. 23 shows a further embodiment on the basis of the exemplary embodiment shown in FIG. 2. Here, too, the flavoring metering means 39 leads into the filling-product line 3 downstream of the filling-product valve 32.

Figure 24:
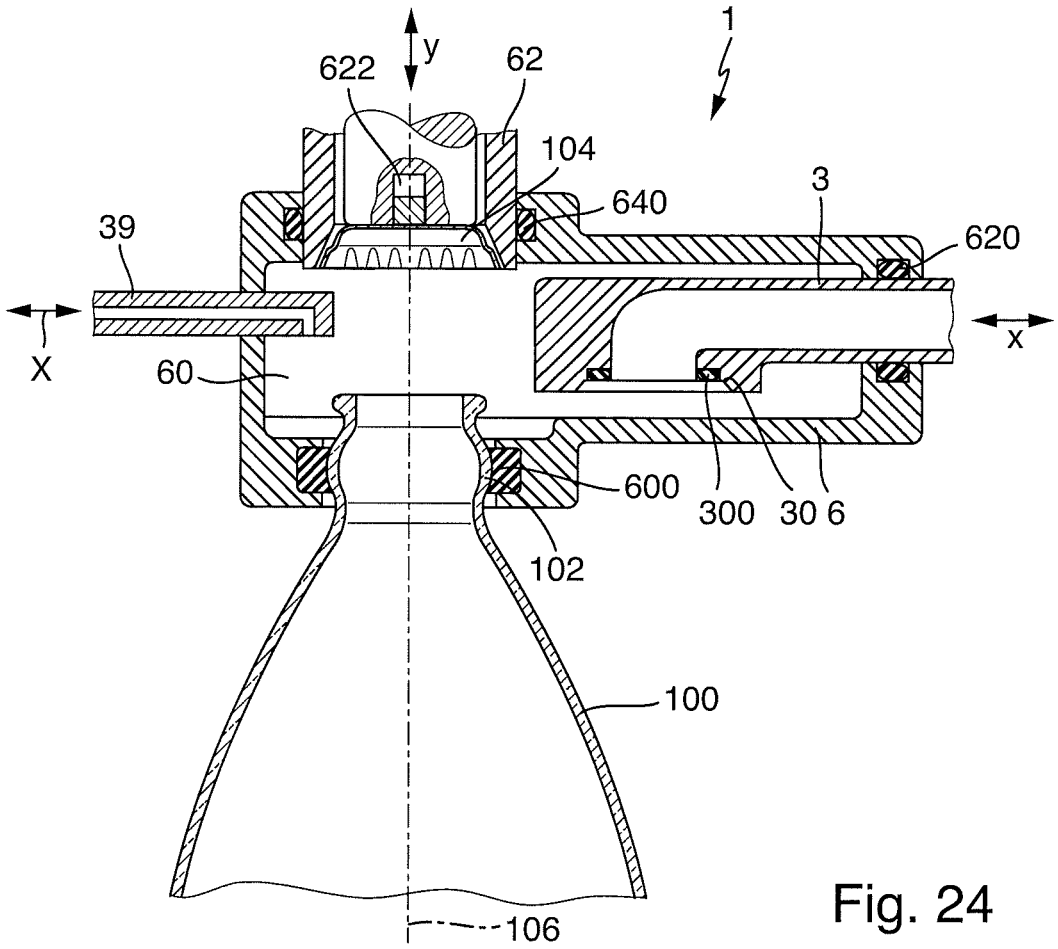
FIG. 24 shows a schematic sectional illustration of a capping head of a device for filling a container according to FIG. 4, in a development with a flavoring metering means.

FIG. 24 shows a further embodiment on the basis of the device 1 shown in FIG. 4. In addition to the schematically indicated and displaceable or pivotable filling-product line 3, the inlet of a flavoring metering means 39 is also provided in the capper head 6.

The flavoring metering means 39 can accordingly be positioned over the mouth of the container 100 in order to meter flavorings and/or beverage additives and/or beverage ingredients into the container 100. In this case, the flavoring metering means 39 can be positioned over the mouth prior to the filling of the container 100 with the filling product or following the conclusion of the filling operation. The filling-product line 3 and the flavoring metering means 39 accordingly alternate in position over the mouth of the container 100.

Where applicable, all individual features which are illustrated in the individual exemplary embodiments can be combined with one another and/or exchanged without departing from the scope of the invention.

The invention claimed is:

1. A method for filling a container having a mouth with a beverage, comprising: providing a capping head comprising a capping-head space that is sealed off from an environment outside the capping-head space, wherein the capping-head space accommodates a filling product line having a working end configured to facilitate an evacuation of the container and feeding the beverage into the container, and a capper configured to cap the container;

providing a beverage under a positive pressure;

sealingly positioning the capping head over the mouth of the container;

moving the working end of the filling product line to position the filling product line within the capping-head space;

extending the filling product line such that the working end is positioned over the mouth of the container;

evacuating, via the working end of the filling product line, the container to achieve a negative pressure;

feeding, via the working end of the filling product line, the beverage into the evacuated container;

retracting the filling product line within the capping-head space to displace the working end of the filling product line from over the mouth of the container;

after feeding the beverage into the container, capping, via the capper, the container without depressurization of the container to ambient pressure; and discharging the capped container from the capping-head space.

2. The method of claim 1, wherein the negative pressure is an absolute pressure of about 0.5 bar to 0.05 bar.

3. The method of claim 1, wherein the positive pressure is an absolute pressure of about 1 bar to 9 bar.

4. The method of claim 1, wherein the positive pressure is an absolute pressure of about 1.1 bar to 6 bar or an absolute pressure of about 1.6 bar to 9 bar.

5. The method of claim 1, further comprising subjecting the container to a pressurizing gas at an absolute pressure of about 3.5 bar to 7 bar after the beverage has been fed in the container.

6. The method of claim 1, further comprising subjecting the container to a pressurizing gas that is provided at a positive pressure that is equal to the positive pressure of the beverage.

7. The method of claim 1, further comprising purging the container with a purge gas before evacuating the container.

8. The method of claim 1, wherein the container is capped at an absolute pressure of about 2 bar to 9 bar.

9. The method of claim 1, further comprising introducing the container into an evacuable chamber before the container is evacuated.

10. The method of claim 1, wherein the filling product line supplies a vacuum, the beverage, and a pressurizing gas.

11. The method of claim 1, further comprising metering one or more of a flavoring additive, a beverage additive, or a beverage ingredient into the container.

12. A device for filling a container having a mouth comprising:

a beverage supply configured to supply a beverage;

a capping head comprising a capping-head space that is sealed off from an environment outside the capping-head space, wherein the capping-head space accommodates a filling product line, a capper, and the mouth of the container, the filling product line in fluidic communication with the container and configured to facilitate an evacuation of the container and feeding the beverage into the evacuated container;

a vacuum device configured to evacuate the container;

a control device configured to control the vacuum device and the beverage supply, wherein the control device instructs the vacuum device to evacuate the container before the beverage is introduced into the evacuated container; and, the capper configured to cap a filled container without depressurization of the filled container to ambient pressure;

wherein:

the filling product line includes a working end configured to move within the capping-head space to fluidicly connect and disconnect the container from the filling product line, and the capper is configured to be raised and lowered within the capping-head space to connect and disconnect the container from the capper.

13. The device of claim 12, wherein the beverage supply is configured as a beverage reservoir having a gas space or as a voidlessly filled line.

14. The device of claim 12, further comprising a flavoring meter for metering one or more of a flavoring additive, a beverage additive, or a beverage ingredient into the container.

15. A method for filling a container having a mouth with a beverage, comprising:

providing a capping head comprising a capping-head space that is sealed off from an environment outside the capping-head space, wherein the capping-head space accommodates a filling product line having a working end configured to facilitate an evacuation of the container and feeding the beverage into the container, and a capper configured to cap the container;

sealingly positioning the capping head over the mouth of the container;

extending the filling product line to position the working end of the filling product line within the capping-head space;

fluidicly connecting the container to the filling product line;

evacuating, via the filling product line, the container to achieve a negative pressure;

feeding, via the filling product line, the beverage provided under a positive pressure into the evacuated container;

retracting the working end of the filling product line within the capping-head space to fluidicly disconnect the container from the filling product line;

lowering the capper onto the container mouth in the capping-head space;

capping, via the capper, the container without depressurization of the container to ambient pressure; and raising the capper off the container in the capping-head space.

16. The method of claim 1, wherein during feeding of the beverage into the evacuated container, there is only fluid flow into the container and the feeding of the beverage is carried out with the entire cross section of the mouth of the container being utilized.

17. The device of claim 12, wherein the filling product line has the same cross section as the cross section of the mouth of the container.

18. The method of claim 15, wherein during feeding of the beverage into the evacuated container, there is only fluid flow into the container and the feeding of the beverage is carried out with the entire cross section of the mouth of the container being utilized.

* * * * *